US008733895B2

(12) United States Patent
Tanaka et al.

(10) Patent No.: US 8,733,895 B2
(45) Date of Patent: May 27, 2014

(54) INK-JET HEAD

(71) Applicant: Brother Kogyo Kabushiki Kaisha, Aichi-Ken (JP)

(72) Inventors: Taiki Tanaka, Yokkaichi (JP); Keiji Kura, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/742,906

(22) Filed: Jan. 16, 2013

(65) Prior Publication Data

US 2013/0182041 A1 Jul. 18, 2013

(30) Foreign Application Priority Data

Jan. 17, 2012 (JP) ..... 2012-006933

(51) Int. Cl.
*B41J 2/21* (2006.01)

(52) U.S. Cl.
USPC ..... 347/43; 347/40

(58) Field of Classification Search
USPC ..... 347/40, 43
See application file for complete search history.

(56) References Cited

U.S. PATENT DOCUMENTS 8,231,203 B2 * 7/2012 Akama et al. ..... 347/43

FOREIGN PATENT DOCUMENTS

JP 2010-42555 2/2010

* cited by examiner

*Primary Examiner* — Lamson Nguyen
(74) *Attorney, Agent, or Firm* — Frommer Lawrence & Haug LLP

(57) ABSTRACT

An ink-jet head includes: a first nozzle group; a second nozzle group; a first common ink chamber; and a second common ink chamber. With respect to a first direction, nozzles constituting the first nozzle group and nozzles constituting the second nozzle group are arranged alternately to complement each other, the first nozzle group includes a first nozzle and a second nozzle which deviates from the first nozzle with respect to a second direction perpendicular to the first direction, the second nozzle group includes a third nozzle arranged adjacent to the first nozzle with respect to the first direction and a fourth nozzle arranged adjacent to the second nozzle with respect to the first direction, and with respect to the second direction, the fourth nozzle deviates from the third nozzle in a direction opposite to a direction in which the second nozzle deviates from the first nozzle.

7 Claims, 15 Drawing Sheets

INK-JET HEAD

CROSS REFERENCE TO RELATED APPLICATION

The present application claims priority from Japanese Patent Application No. 2012-006933 filed on Jan. 17, 2012, the disclosure of which is incorporated herein by reference in its entirety.

BACKGROUND OF THE INVENTION

1. Field of the Invention

The present invention relates to ink-jet heads for jetting ink.

2. Description of the Related Art

An ordinary ink-jet head has a plurality of nozzles aligned along one predetermined direction, and can form a linear dot row on a recording medium by jetting liquid drops of ink from the plurality of nozzles respectively.

Japanese Patent Application Laid-Open No. 2010-42555 (FIGS. 3 and 4) discloses a so-called line-type ink-jet head which has numerous nozzles aligned in a main scanning direction (a width direction of the recording medium being transported). In the ink-jet head of Japanese Patent Application Laid-Open No. 2010-42555, the plurality of nozzles to form one dot row on the recording medium are not arranged linearly along the main scanning direction, but one part of the nozzles has positional deviation from another adjacent part of the nozzles with respect to a secondary scanning direction (a transport direction of the recording medium) perpendicular to the main scanning direction. That is, it is configured that the plurality of nozzles in rows along the main scanning direction are divided into two types of nozzle groups (to be referred to as divisional nozzle groups hereinbelow) differing in position along the secondary scanning direction, and these two types of nozzle groups are arranged alternately along the main scanning direction. Further, in the inkjet head of Japanese Patent Application Laid-Open No. 2010-42555, ink supply ports (openings of a flow passage unit) are provided for the plurality of divisional nozzle groups, respectively. That is, ink is supplied independently to each of the plurality of divisional nozzle groups.

As shown in FIG. 11A, in the configuration of the ink-jet head, disclosed by Japanese Patent Application Laid-Open No. 2010-42555, in which the numerous nozzles arranged along the main scanning direction are divided into the plurality of divisional nozzle groups, if these plurality of divisional nozzle groups are connected to one common ink chamber and a common ink supply system is established, it is possible to simplify the flow passage structure. However, when such a configuration is adopted, problems as follows are to occur.

In an ink-jet head 200 shown in FIG. 11A, a plurality of nozzles 201 are divided into three divisional nozzle groups 202 (202*a*, 202*b* and 202*c*). Further, the three divisional nozzle groups 202 communicate with one common ink chamber 204 which is connected to an ink supply port 203. Among the above three divisional nozzle groups 202, the central divisional nozzle group 202*b* has positional deviation from the two divisional nozzle groups 202*a* and 202*c* to the upstream side with respect to the secondary scanning direction.

When carrying out recording on an incoming sheet of recording paper 100 transported in the secondary scanning direction, ink is jetted first from the nozzles 201 positioned on the upstream side in the secondary scanning direction. That is, ink is jetted in an order from the divisional nozzle group 202*b* to the divisional nozzle groups 202*a* and 202*c*. Here, the divisional nozzle group 202*b* which jets ink earlier carries out ink jetting with no ink flow occurring in the common ink chamber 204. On the other hand, the divisional nozzle groups 202*a* and 202*c* which jet ink later carry out ink jetting with an ink flow occurring in the common ink chamber 204 due to the earlier ink jetting by the divisional nozzle group 202*b*. Therefore, in the divisional nozzle groups 202*a* and 202*c* which jet ink later, since the ink flow has already occurred in the common ink chamber 204 just before their own ink jetting, pressure loss occurs at the time of supplying the ink to the nozzles 201, thereby delaying the ink supply to the nozzles 201. That is, between the divisional nozzle group 202*b* which jets ink earlier and the divisional nozzle groups 202*a* and 202*c* which jets ink later, since a difference occurs in the discharge or ejection quantity of liquid droplets, when one dot row is formed by the three divisional nozzle groups 202, dark color dots D1 and light color dots D2 are formed unevenly in this one dot row as shown in FIG. 11B to present a distinct shading.

SUMMARY OF THE INVENTION

An object of the present invention is to realize a common ink supply to a plurality of divisional nozzle groups so as to simplify the flow passage structure and to make any shading due to the difference in jetting timings of the divisional nozzle groups be less noticeable in one dot row.

According to an aspect of the present invention, there is provided an ink-jet head configured to jet ink, including: a first nozzle group constituted by a plurality of nozzles which are arranged with intervals therebetween with respect to a first direction; a second nozzle group constituted by a plurality of nozzles which are different from the nozzles constituting the first nozzle group and arranged with intervals therebetween with respect to the first direction; a first common ink chamber which communicates commonly with the nozzles constituting the first nozzle group; and a second common ink chamber which communicates commonly with the nozzles constituting the second nozzle group, wherein with respect to the first direction, the nozzles constituting the first nozzle group and the nozzles constituting the second nozzle group are arranged alternately to complement each other, the first nozzle group includes a first nozzle and a second nozzle which deviates from the first nozzle with respect to a second direction perpendicular to the first direction, the second nozzle group includes a third nozzle which is arranged adjacent to the first nozzle with respect to the first direction, and a fourth nozzle which is arranged adjacent to the second nozzle with respect to the first direction, and with respect to the second direction, the fourth nozzle deviates from the third nozzle in a direction opposite to a direction in which the second nozzle deviates from the first nozzle.

According to the present invention, the plurality of nozzles of the first nozzle group and the plurality of nozzles of the second nozzle group are arranged alternately in the first direction to complement each other. The term "complement" used here refers to the fact that the plurality of nozzles of the first nozzle group and the plurality of nozzles of the second nozzle group cooperatively form one dot row by arranging the dots formed by jetting from one of the first and second nozzle group between the dots formed by jetting from the other of the first and second nozzle group.

By virtue of the ink-jet head according to the above aspect of the present invention, it is possible to simplify the flow passage structure and to make any shading due to the difference in jetting timings of the nozzle groups be less noticeable in one dot row.

DESCRIPTION OF THE PREFERRED EMBODIMENT

Figure 1:
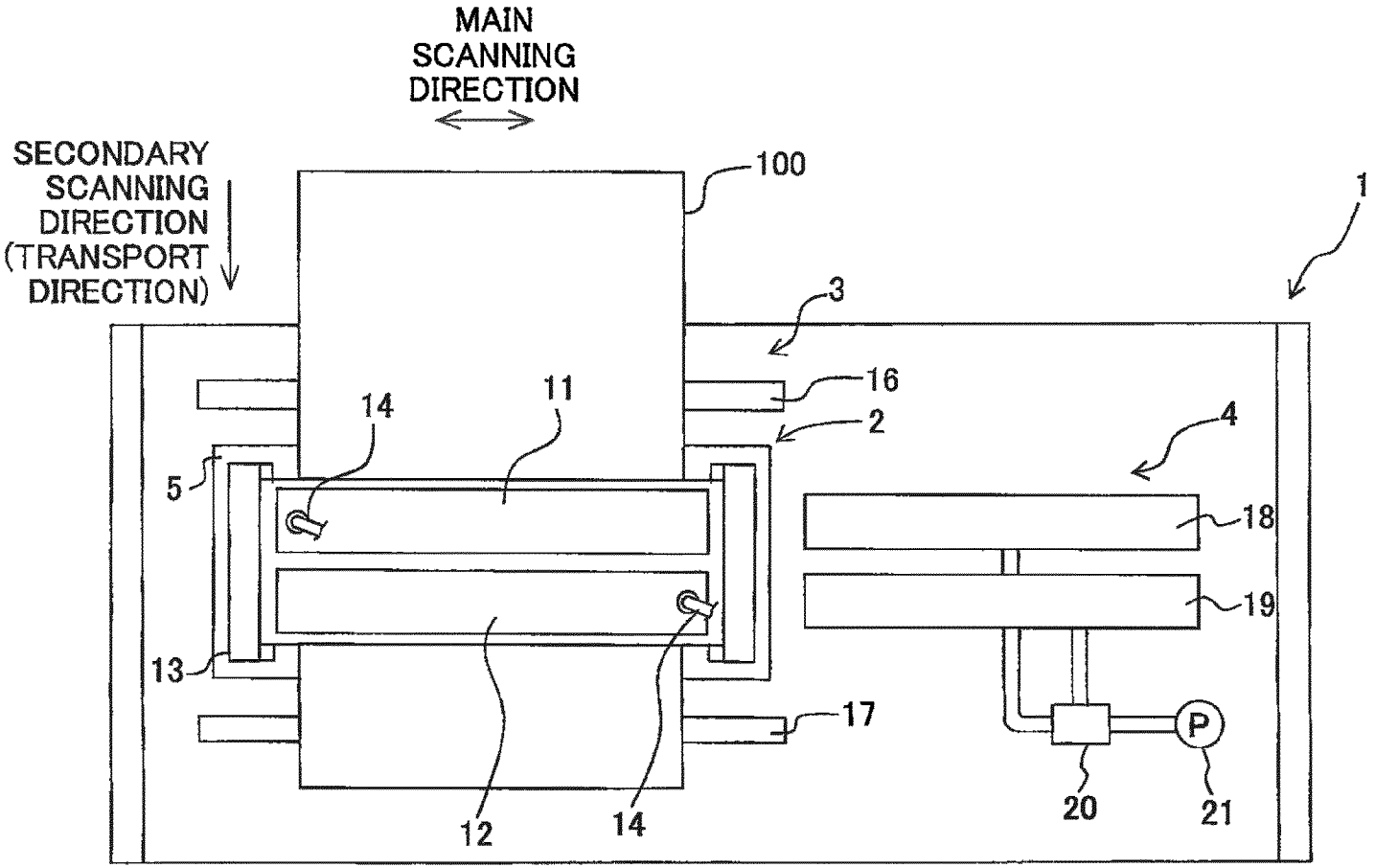
FIG. 1 is a top view of an ink jet printer according to an embodiment of the present invention.

Next, a preferred embodiment of the present invention will be explained. As shown in FIG. 1, an ink jet printer 1 includes an ink-jet head 2 jetting ink, a transport mechanism 3 transporting sheets of the recording paper 100 to the ink-jet head 2, a maintenance unit 4 carrying out maintenance and recovery of the liquid drop jet performance of the ink-jet head 2, etc. Further, the vertical or up-down direction in FIG. 1 is defined to be a front-rear direction (secondary scanning direction: transport direction of the recording paper), the horizontal or left-right direction in FIG. 1 is defined to be a left-right direction (main scanning direction), and the perpendicular direction to the paper sheet of FIG. 1 is defined to be an up-down direction (front side of the paper sheet is the upside). Hereinbelow, explanations will be made by using appropriate directional terms such as front/rear, left/right, and up/down, according to the above definition. Further, the main scanning direction and the secondary scanning direction correspond to a first direction and a second direction of the present invention, respectively.

As shown in FIG. 1, the ink-jet head 2 is arranged to stay above a horizontally placed platen 5 (on the front side of the paper sheet of FIG. 1) when image recording is performed onto the recording paper 100. Further, the ink-jet head 2 is a so-called line-type ink-jet head which has a number of nozzles aligned in the main scanning direction and jets liquid droplets of ink toward the recording paper 100 being transported in the secondary scanning direction in a state that the ink-jet head 2 is fixed at a predetermined position inside the ink jet printer 1. The ink-jet head 2 has a first head unit 11 and a second head unit 12 which are arranged side by side in the secondary scanning direction, and a holding member 13 holding these two head units 11 and 12.

Figure 2:
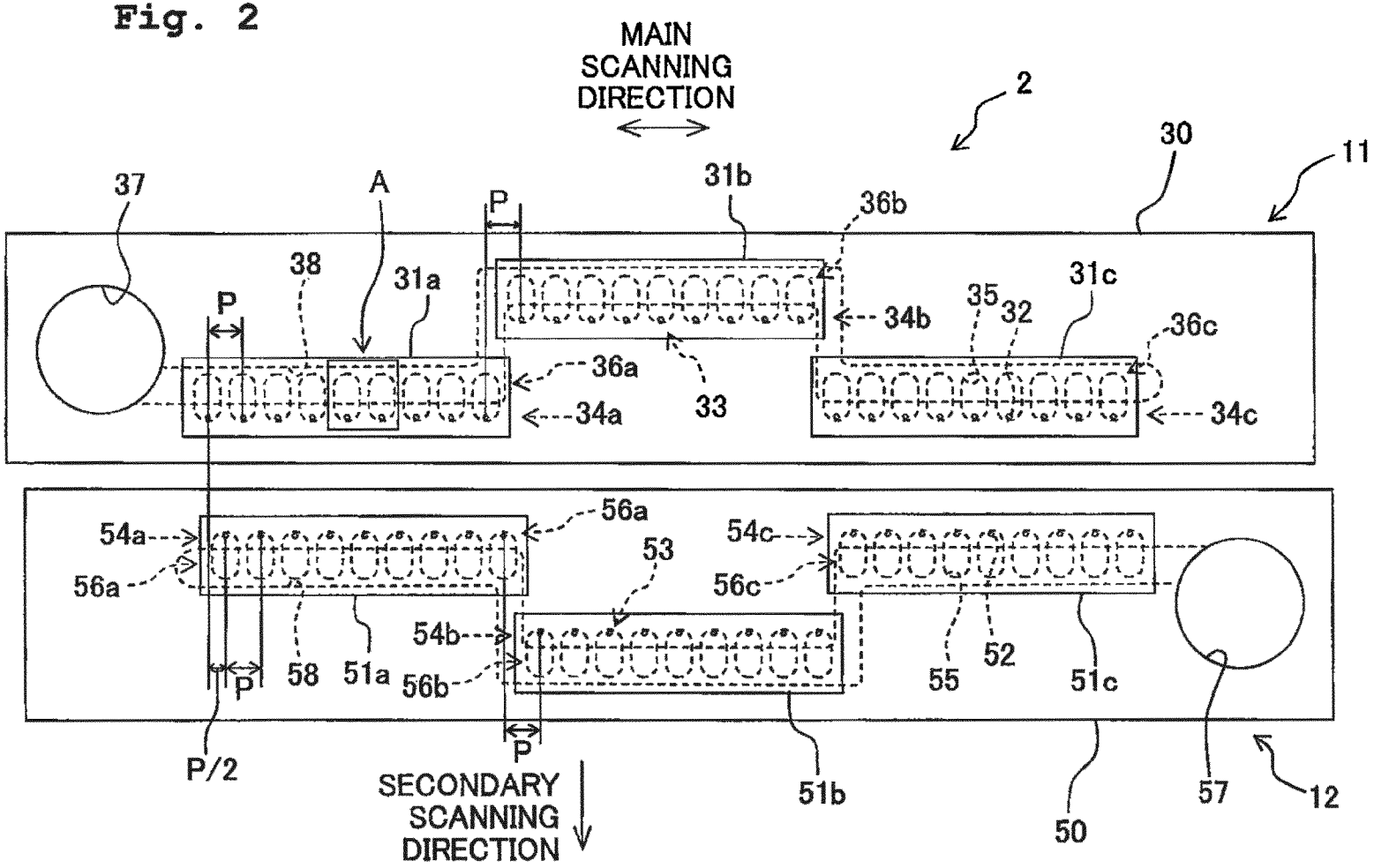
FIG. 2 is a plan view of two head units of an ink-jet head.

FIG. 2 is a plan view of the two head units 11 and 12 of the ink-jet head 2. The first head milt 11 has a plurality of nozzles 32 arranged along the main scanning direction and the second head unit 12 has a plurality of nozzles 52 arranged along the main scanning direction. Further, the two head units 11 and 12 are connected to an unshown ink cartridge through tubes 14. Then, the bead units 11 and 12 jet liquid droplets of ink toward the recording paper 100 on the platen 5 from the nozzles 32 and 52 opening on the downside (the back side of the paper sheet of FIG. 1), respectively. A specific construction of the head units 11 and 12 will be explained later.

The transport mechanism 3 has a feed roller 16 and a discharge roller 17 which are arranged to interpose the ink-jet head 2 therebetween from the front and rear, and transports the recording paper 100 with these two rollers 16 and 17 to the ink-jet head 2 along the platen 5 in the secondary scanning direction. In the embodiment, the secondary scanning direction (the transport direction of the recording paper 100) is a direction orthogonal to the main scanning direction (the alignment direction of the nozzles). However, it is also allowable to have a construction in which the recording paper 100 is transported in a direction inclined a little from the orthogonal direction within the horizontal plane (a direction intersecting with the main scanning direction at an angle other than 90 degrees).

Thus, the ink jet printer 1 is constructed such that while transporting the recording paper 100 in the secondary scanning direction by the rollers 16 and 17 of the transport mechanism 3, liquid droplets of ink are jetted onto the recording paper 100 from the two head units 11 and 12 of the ink-jet head 2 to record a desired image on the recording paper 100.

As shown in FIG. 1, the maintenance unit 4 is placed to stay on the right side of the platen 5 when maintenance of the ink-jet head 2 is not performed. On the other hand, when it becomes necessary to maintain the ink-jet head 2, the maintenance unit 4 is configured to be movable to a maintenance position below the ink-jet head 2 to face the two head units 11 and 12 by a position transfer mechanism (illustration omitted) having an appropriate construction.

The maintenance unit 4 has two cap members 18 and 19 made of an elastic material such as rubber or the like, a suction pump 21 connected to the two cap members 18 and 19 via a switching device 20, etc. The two cap members 18 and 19 is driven independently of each other in the up-down direction by a cap lifting and lowering mechanism (illustration omitted) constructed by a driving source such as a motor or the like, and a power transmission member such as gears and the like. Then, when the maintenance unit 4 is positioned at the maintenance position and the cap members 18 and 19 are attached firmly to the head units 11 and 12 by being pressed respectively against the head units 11 and 12, the cap members 18 and 19 cover the lower surfaces of the head units 11 and 12 (the liquid drop jet surfaces) on which the nozzles are open, respectively. By virtue of this, when the head units 11 and 12 are not in use, the nozzles are sealed from the air, thereby preventing the ink inside the nozzles from being dried.

The switching device 20 switches the connecting destination of the suction pump 21 between the two cap members 18 and 19. Then, by reducing the internal pressure of the cap member 18 (19), in a state that the cap member 18 (19) connected to the suction pump 21 covers the liquid droplet jetting surface of the head unit 11 (12), ink is forcibly discharged from the respective nozzles 32 (52) of the head unit 11 (12) (suction purge). By this suction purge, foreign matters and air bubbles mixed into the ink flow passages, thickened ink caused by internal drying of the nozzles, etc, which may otherwise cause jetting failure of the nozzles, or jetting abnormity such as jet inflection are discharged from the nozzles 32 (52).

In the foregoing explanation, it is stated that in order to perform maintenance, the maintenance unit 4 is moved to a position at which the maintenance unit 4 faces the head units 11 and 12. However, it is also allowable to move the head units 11 and 12 to the maintenance unit 4 so that the maintenance unit 4 and the head units 11 and 12 face each other.

Next, a specific structure of the head units 11 and 12 will be explained. As shown in FIG. 2, the two head units 11 and 12 of the embodiment have the same construction. However, the two head units 11 and 12 are different in arrangement posture. That is, the second head unit 12 is arranged in such a posture as it is turned 180 degrees with respect to the first head unit 11 within a horizontal plane (within a plane parallel to the liquid droplet jetting surfaces of the head units 11 and 12). In this manner, since the two head units 11 and 12 have the same structure, the structure of the first head unit 11 will be explained hereinbelow in the main, while the second head unit 12 will be explained only on its different aspects from the first head unit 11.

<The First Head Unit>

As shown in FIG. 2, the first head unit 11 has a first flow passage unit 30, and three actuators 31 (31*a*, 31*b* and 31*c*) provided to the first flow passage unit 30.

Figure 3A:
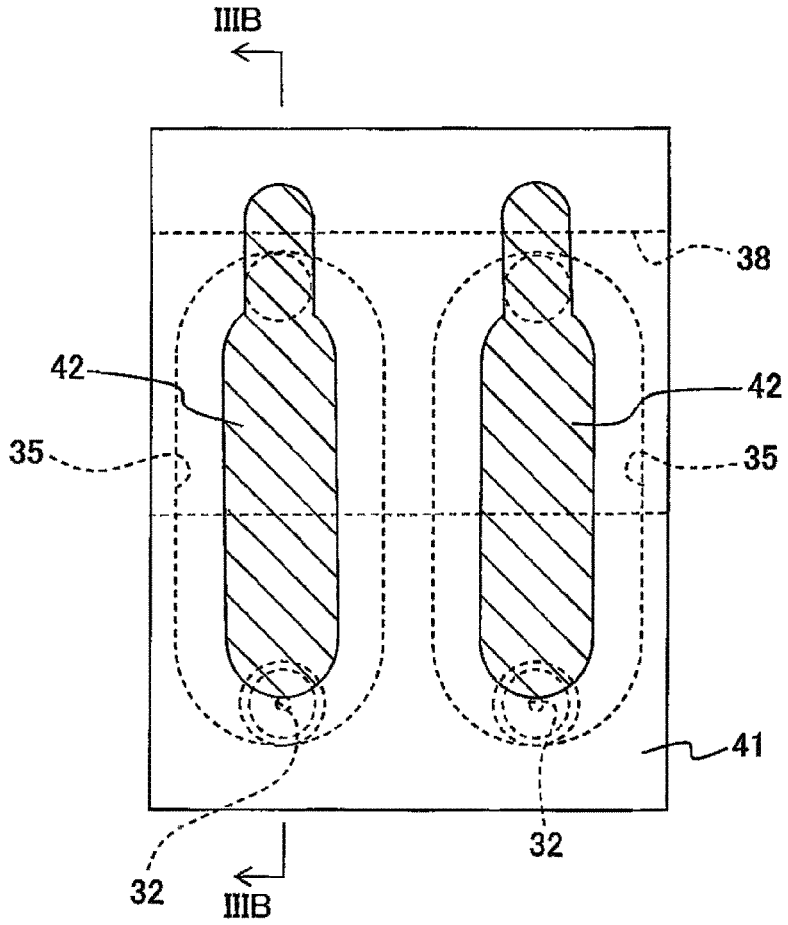
FIG. 3A is an enlarged view of part A enclosed in the rectangular frame of FIG. 2.
Figure 3B:
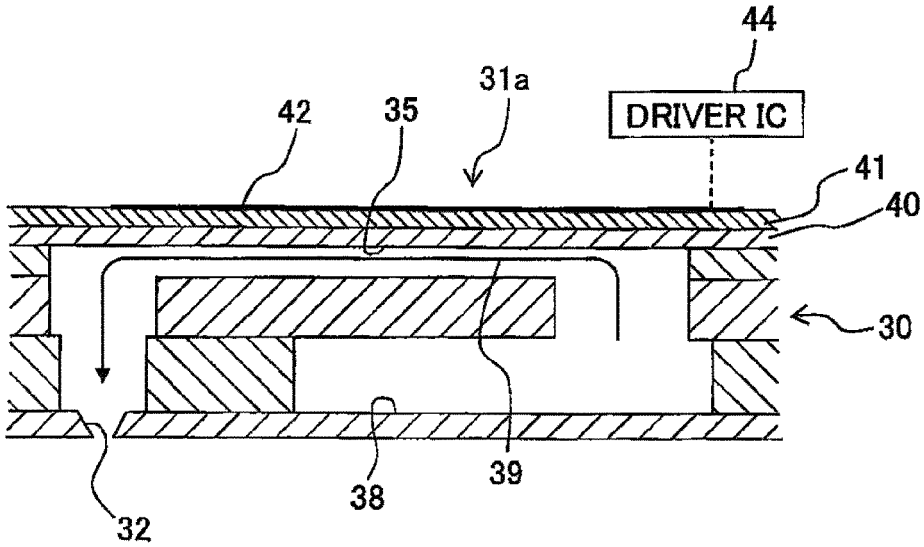
FIG. 3B is a cross-sectional view along the line IIIB-IIIB in FIG. 3A.

As shown in FIG. 3B, the first flow passage unit 30 (a first flow passage assembly) has a structure in which a plurality of rectangular plates elongated in the main scanning direction are stacked. In the first flow passage unit 30, ink flow passages are formed with such a configuration as follows.

The first flow passage unit 30 has a first nozzle group 33 composed of the plurality of nozzles 32 opened respectively on a lower surface of the first flow passage unit 30 and aligned with pitch (interval) P along the main scanning direction. However, the plurality of nozzles 32 are not aligned linearly in the main scanning direction. In more detail, in the first nozzle group 33, the nozzles 32 arranged at central portion in the main scanning direction are positioned on the upstream side of the secondary scanning direction as compared with the other nozzles 32 arranged on both end sides in the main scanning direction. By virtue of this, the first nozzle group 33 is divided into three divisional nozzle groups 34*a*, 34*b*, and 34*c* having positional deviation with respect to the secondary scanning direction. In other words, the divisional nozzle groups 34*a* and 34*c* positioned on the downstream side along the secondary scanning direction (on the lower side in FIG. 2) and the divisional nozzle group 34*b* positioned on the upstream side along the secondary scanning direction (on the upper side in FIG. 2) are arranged alternately along the main scanning direction. Further, the number of the nozzles 32 constituting each of the three divisional nozzle groups 34 is mutually equal. FIG. 2 shows an example in which each of the three divisional nozzle groups 34 is constituted by nine nozzles 32. Further, as is understood from FIG. 2, the interval between the adjacent nozzles 32 of the divisional nozzle groups 34*a* and 34*b* and the interval between the adjacent nozzles 32 of the divisional nozzle groups 34*b* and 34*c* are also equal to pitch P. That is, although the first nozzle group 33 is divided into the three divisional nozzle groups 34*a* to 34*c*, the nozzles 32 constituting the first nozzle group 33 are all arranged by the same alignment pitch P with respect to the main scanning direction.

Further, among the three divisional nozzle groups 34*a*, 34*b* and 34*c*, the two divisional nozzle groups 34*a* and 34*c* on the both end sides in the main scanning direction correspond to a first divisional nozzle group of a first nozzle group of the present invention, and the central divisional nozzle group 34*b* corresponds to a second divisional nozzle group of the present invention. An explanation on the reason why the first nozzle group 33 is divided into the three divisional nozzle groups 34*a* to 34*c* in the above manner will be made hereinafter. Further, presuming that any nozzle 32 included in the divisional nozzle groups 34*a* or 34*c* corresponds to a first nozzle of the present invention, any nozzle 32 included in the divisional nozzle group 34*b* corresponds to a second nozzle of the present invention. Presuming that any nozzle 32 included in the divisional nozzle groups 34*a* or 34*c* corresponds to the second nozzle of the present invention, any nozzle 32 included in the divisional nozzle group 34*b* corresponds to the first nozzle of the present invention.

In the upper surface of the first flow passage unit 30, a plurality of first pressure chambers 35 are formed to communicate with the plurality of nozzles 32, respectively. Corresponding to the three divisional nozzle groups 34*a*, 34*b* and 34*c* of the first nozzle group 33, the plurality of first pressure chambers 35 are divided into three pressure chamber groups 36*a*, 36*b* and 36*c* having positional deviation with respect to the secondary scanning direction. Among the three pressure chamber groups 36*a* to 36*c*, the number of the first pressure chambers 35 is mutually equal (nine in FIG. 2). The upper sides of the three pressure chamber groups 36*a* to 36*c* are covered by three actuators 31*a* to 31*c* which will be described hereinafter.

in one end portion (the left end portion) in the main scanning direction of the upper surface of the first flow passage unit 30, an ink supply port 37 which is connected to the tube 14 (see FIG. 1) is formed. Further, inside the first flow passage unit 30, a manifold 38 (a first common ink chamber) which communicates with the ink supply port 37 is formed. The manifold 38 extends from the left end portion of the first flow passage unit 30 at which the ink supply port 37 is formed, toward the right end portion in the main scanning direction, so as to communicate with all of the first pressure chambers 35. However, in order to communicate commonly with all of the first pressure chambers 35, the manifold 38 extends to pass below the three pressure chamber groups 36*a*, 36*b*, 36*c* in this order. As a result, the manifold 38 is bent to the upstream side in the secondary scanning direction at the central portion in the main scanning direction. In this manner, in the embodiment, the manifold 38 which communicates with the one ink supply port 37 communicates with all of the first pressure chambers 35 (all of the nozzles 32 of the first nozzle group 33). That is, the ink supply system is made common or commonalized to all of the first pressure chambers 35. Therefore, the flow passage structure becomes simple.

Then, as shown in FIG. 3B, in the first flow passage unit 30, a plurality of individual ink flow passages 39 are formed to branch from the manifold 38 up to the nozzles 32 through the first pressure chambers 35, respectively.

As shown in FIG. 2, on the upper surface of the first flow passage unit 30, the three piezoelectric actuators 31*a*, 31*b* and 31*c* which drive the three divisional nozzle groups 34*a*, 34*b* and 34*c* respectively are arranged. The three piezoelectric actuators 31*a*, 31*b* and 31*c* are arranged respectively above the areas at which the three pressure chamber groups 36*a*, 36*b* and 36*c* are formed. Therefore, the central piezoelectric actuator 31*b* has positional deviation from the two piezoelectric actuators 31*a* and 31*c* to the upstream side with respect to the secondary scanning direction. Further, in the first flow passage unit 30, the two piezoelectric actuators 31*a* and 31*c* positioned on both end sides in the main scanning direction correspond to first actuator of the present invention, and the piezoelectric actuator 31*b* positioned at the central portion in the main scanning direction corresponds to a second actuator of the present invention. In other words, the first actuator positioned on the downstream side in the secondary scanning direction and the second actuator positioned on the upstream side in the secondary scanning direction are arranged alternately along the main scanning direction.

The number of the first pressure chambers 35 which are covered (i.e. the number of the first pressure chambers 35 which are driven) by each of the three piezoelectric actuators 31*a* to 31*c* is same among the three piezoelectric actuators 31*a* to 31*c*, and the three piezoelectric actuators 31*a* to 31*c* have the same construction. Hereinbelow, explanations will be made only for the piezoelectric actuator 31*a* but be omitted for the construction of the piezoelectric actuators 31*b* and 31*c*. As shown in FIG. 3B, the piezoelectric actuator 31*a* includes a vibration plate 40 covering the plurality of first pressure chambers 35, a piezoelectric layer 41 arranged on the upper surface of the vibration plate 40, and a plurality of individual electrodes 42 corresponding to the plurality of first pressure chambers 35. Each of the plurality of individual electrodes 42 is connected to a driver IC 44 which drives the piezoelectric actuator 31*a*. Further, the vibration plate 40 is formed of a metallic material to play the role of a common electrode which faces the plurality of individual electrodes 42 across the piezoelectric layer 41. Further, the vibration plate 40 is connected to the ground wire of the driver IC 44 and thus constantly kept at the ground potential. Further, the portions of the piezoelectric layer 41 sandwiched between the vibration plate 40 and the individual electrodes 42 are polarized in the thickness direction thereof.

The following description sets forth the function of the piezoelectric actuator 31*a* for jetting the ink from the nozzles 32. When a drive signal is applied selectively to the plurality of individual electrodes 42 from the driver IC 44, a potential difference occurs between the individual electrodes 42 on the upper side of the piezoelectric layer 41 and the vibration plate 40 as a common electrode kept at the ground potential on the lower side of the piezoelectric layer 41, thereby generating an electric field at the portions sandwiched between the individual electrodes 42 and the vibration plate 40 in the thickness direction thereof. At this time, since the polarization direction of the piezoelectric layer 41 is conformed to the direction of the electric field, the piezoelectric layer 41 extends in the thickness direction, which is the polarization direction, and contracts in the planar direction. Further, along with the contractive deformation of the piezoelectric layer 41, the portions of the vibration plate 40 facing the first pressure chambers 35 bend or deflect to project toward the first pressure chambers 35 (unimorph deformation). At this time, because the first pressure chambers 35 undergo a decrease in volume, a pressure is applied to the ink therein, and thus liquid droplets of the ink are jetted from the nozzles 32 in communication with the first pressure chambers 35.

<The Second Head Unit>

As described previously, the second head unit 12 has the same structure as the first head unit 11. The second head unit 12 is arranged at a position on the downstream side in the secondary scanning direction from the first head unit 11, and is arranged in the posture as it is turned 180 degrees with respect to the first head unit 11 within the horizontal plane. With this, the second head unit 12 differs from the first head unit 11 in arrangement of the nozzles, pressure chambers and the like, and arrangement of the three actuators. As shown in FIG. 2, the second head unit 12 includes a second flow passage unit 50, and three piezoelectric actuators 51 (51*a*, 51*b* and 51*c*).

The second flow passage unit 50 (a second flow passage assembly) has a second nozzle group 53 composed of the plurality of nozzles 52 arranged with pitch P with respect to the main scanning direction. The second nozzle group 53 is divided into three divisional nozzle groups 54*a*, 54*b* and 54*c*, and these three divisional nozzle groups 54*a* to 54*c* are arranged to align respectively with the three divisional nozzle groups 34*a* to 34*c* of the first head unit 11 in the secondary scanning direction. However, differently from the first head unit 11, the central divisional nozzle group 54*b* has positional deviation from the two divisional nozzle groups 54*a* and 54*c* to the downstream side in the secondary scanning direction. Further, among the three divisional nozzle groups 54*a*, 54*b* and 54*c*, the two divisional nozzle groups 54*a* and 54*c* correspond to a third divisional nozzle group of a second nozzle group of the present invention, and the central divisional nozzle group 54*b* corresponds to a fourth divisional nozzle group of the second nozzle group of the present invention. Further, assuming that any one nozzle 32*a* included in the divisional nozzle group 34*a* or 34*c* corresponds to the first nozzle of the present invention, and that any one nozzle 32*b* included in the divisional nozzle group 34*b* corresponds to the second nozzle of the present invention, a nozzle 52*a* included in the divisional nozzle group 54*a* or 54*c* and adjacent to the nozzle 32*a* with respect to the main scanning direction corresponds to a third nozzle of the present invention, and a nozzle 52*b* included in the divisional nozzle group 54*b* and adjacent to the nozzle 32*b* with respect to the main scanning direction corresponds to a fourth nozzle of the present invention. On the other hand, assuming that any one nozzle 32*a* included in the divisional nozzle group 34*b* corresponds to the first nozzle of the present invention, and that any one nozzle 32*b* included in the divisional nozzle group 34*a* or 34*c* corresponds to the second nozzle of the present invention, a nozzle 52*a* included in the divisional nozzle group 54*b* and adjacent to the nozzle 32*a* with respect to the main scanning direction corresponds to the third nozzle of the present invention, and a nozzle 52*b* included in the divisional nozzle group 54*a* or 54*c* and adjacent to the nozzle 32*b* with respect to the main scanning direction corresponds to the fourth nozzle of the present invention.

In other words, the central divisional nozzle group 34*b* of the first nozzle group 33 is located farther away from the second nozzle group 53 than the two divisional nozzle groups 34*a* and 34*c* with respect to the secondary scanning direction. Further, the central divisional nozzle group 54*b* of the second nozzle group 53 is located farther away from the first nozzle group 33 than the two divisional nozzle groups 54*a* and 54*c* on the left side and the right side of the divisional nozzle group 54*b* with respect to the secondary scanning direction. That is, between the first nozzle group 33 and the second nozzle group 53, there is such a relation of arrangement as the pair of the central divisional nozzle groups 34*b* and 54*b* are far from each other while the pair of the left divisional nozzle groups 34*a* and 54*a*, as well as the pair of the right divisional nozzle groups 34*c* and 54*c*, are close to each other.

Further, the second head unit 12 is arranged to deviate rightward from the first head unit 11 by half of the alignment pitch P (P/2) of the nozzles 52. By virtue of this, the plurality of nozzles 32 of the first head unit 11 and the plurality of nozzles 52 of the second head unit 12 are arranged alternately with respect to the main scanning direction to complement each other. That is, the plurality of nozzles 32 of the first head unit 11 and the plurality of nozzles 52 of the second head unit 12 are in such an arrangement relation that it is possible to cooperatively form one dot row with a P/2 dot pitch by arranging, on the recording paper 100, dots formed by jetting from one head unit between dots formed by jetting from the other head unit.

The second head unit 12 has a plurality of second pressure chambers 55 which communicate with the plurality of nozzles 52, respectively. The plurality of second pressure chambers 55 are divided into three pressure chamber groups 56*a*, 56*b* and 56*c* and, corresponding to the aforementioned arrangement of the three divisional nozzle groups 54*a* to 54*c*. The central pressure chamber group 56*b* has positional deviation from the two pressure chamber groups 56*a* and 56*c* to the downstream side in the secondary scanning direction. Further, an ink supply port 57 is formed in the right end portion of the upper surface of the second flow passage unit 50, and a manifold 58 (a second common ink chamber) which communicates with the ink supply port 57 is formed. The manifold 58 extends from the ink supply port 57 up to the left end portion of the second flow passage unit 50, passing below the three pressure chamber groups 56*a* to 56*c* while bending midway.

On the upper surface of the second flow passage unit 50, the three piezoelectric actuators 51*a*, 51*b* and 51*c* are arranged respectively above the areas at which the three pressure chamber groups 56*a*, 56*b* and 56*c* are formed. That is, the central piezoelectric actuator 51*b* is arranged to have positional deviation from the two piezoelectric actuators 51*a* and 51*c* to the downstream side with respect to the secondary scanning direction. In the second flow passage unit 50, the two piezoelectric actuators 51*a* and 51*c* positioned on both end sides in the main scanning direction correspond to a third actuator of the present invention, and the piezoelectric actuator 51*b* positioned at the central portion in the main scanning direction corresponds to a fourth actuator of the present invention.

Next, an explanation will be made on the reason why the first nozzle group 33 (the second nozzle group 53) is divided into the three divisional nozzle groups 34*a* to 34*c* (54*a* to 54*c*) having positional deviation with respect to the secondary scanning direction, but not arranged as one linear nozzle row, in the first head unit 11 (the second head unit 12).

As shown in FIG. 1, for a line-type ink-jet head which jets ink onto the transported incoming recording paper 100, it is necessary to align numerous nozzles in the width direction of the recording paper 100 (the main scanning direction). However, if these numerous nozzles are aligned linearly, then such problems will occur as described below.

Figure 4A:
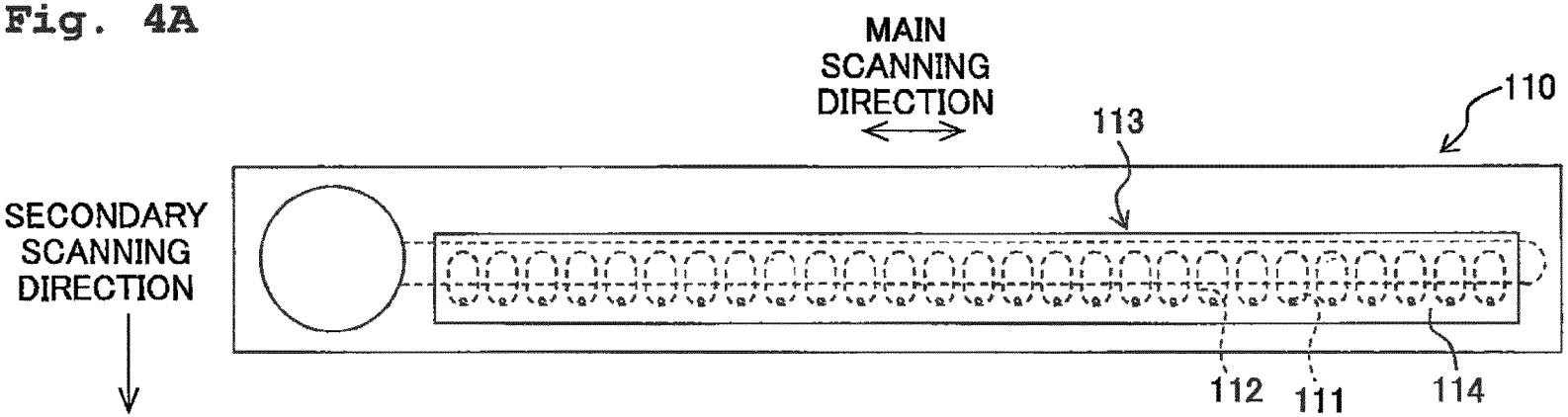
FIGS. 4A and 4B are plan views of a line-type ink-jet head having linearly aligned nozzles.

First, as shown in FIG. 4A, if a plurality of nozzles 111 are aligned linearly in the main scanning direction in a head unit 110, then a plurality of pressure chambers 112 which communicate with the plurality of nozzles 111 are also aligned linearly, respectively. Then, a piezoelectric actuator 113 which is arranged to cover the plurality of pressure chambers 112 has such a shape as elongated in the main scanning direction. However, it is very difficult to fabricate such elongated piezoelectric actuator 113. For example, in order to equalize the discharge or ejection property (ejection quantity and ejection speed) of the plurality of nozzles 111, it is necessary to equalize the thickness of a piezoelectric layer 114 of the piezoelectric actuator 113. Nevertheless, the more elongated the piezoelectric layer 114 becomes, the more difficult it is to equalize the thickness of the piezoelectric layer 114. Further, because the thin and elongated piezoelectric layer 114 is liable to crack or break in fabrication, its handling is also difficult. Further, in the fabrication stage, if any problem occurs only in a portion of the piezoelectric actuator 113 which drives one of the pressure chambers 112, then the piezoelectric actuator 113 still cannot be used. Therefore, the more the number of the pressure chambers 112 to be driven by the one piezoelectric actuator 113 becomes, the higher the probability of the abovementioned occurrence of problem becomes, thereby lowering the fabrication yield.

Figure 4B:
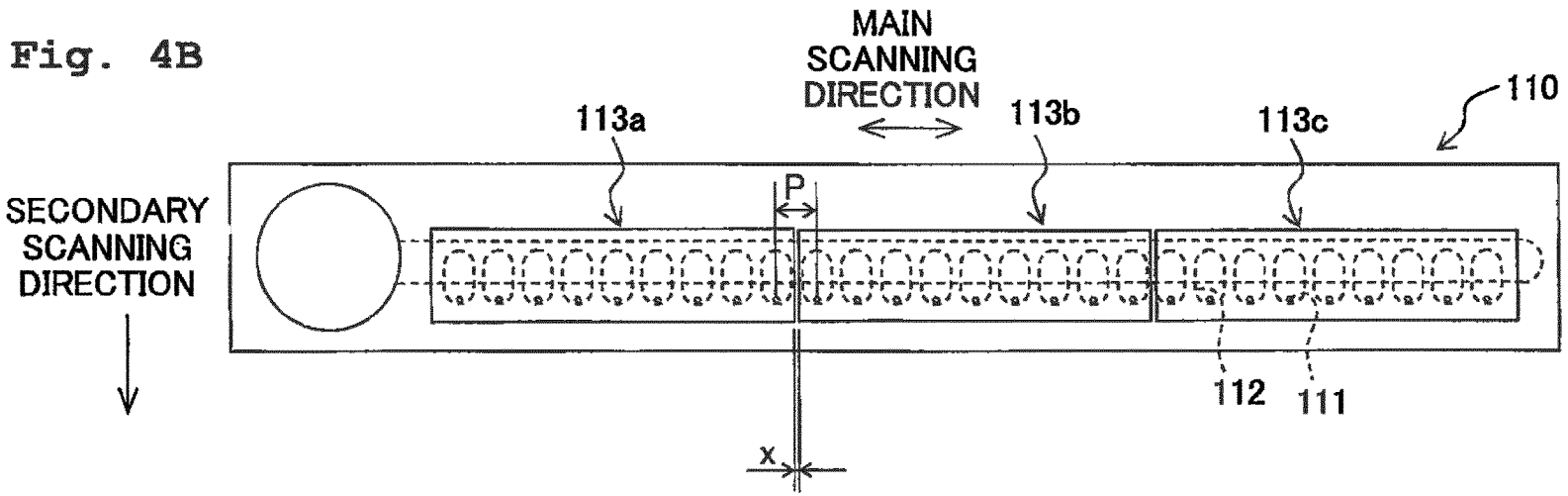

Therefore, it is preferable to divide the elongated piezoelectric actuator 113 into a plurality of small-sized actuators. However, as shown in FIG. 4B, it is difficult to simply align the small-sized piezoelectric actuators 113*a* to 113*c* along the main scanning direction, without changing the alignments of the nozzles 111 and the pressure chambers 112. This is because it is necessary to make the interspace X between the adjacent piezoelectric actuators 113*a* to 113*c* not more than the alignment pitch (interval) P of the nozzles 111 and, moreover, not more than the separate distance between two adjacent pressure chambers 112. Further, even if that is possible, then because some edges of the piezoelectric actuators 113*a* to 113*c* approach some of the pressure chambers 112, it is difficult to drive such pressure chambers 112 in the same manner as driving the other pressure chambers 112. In view of this, as shown in FIG. 2 of the embodiment, if the first nozzle group 33 (the second nozzle group 53) is divided into the three divisional nozzle groups 34 (54), then the three corresponding piezoelectric actuators 31 (51) have positional deviation with respect to the secondary scanning direction. In this case, because it is also allowable to overlap each other in part between the adjacent piezoelectric actuators 31 (51), it becomes easy to arrange the piezoelectric actuators 31 (51).

Further, if the plurality of nozzles 111 are aligned linearly in the main scanning direction as shown in FIG. 4A, then a cap member, which is provided to be put on the head unit 110 to cover the plurality of nozzles 111, is subject to such a shape as elongated in the main scanning direction. Because the elongated cap member is liable to deflection, when it is pressed against the liquid droplet jetting surface of the head unit 110, a part of the cap member may be attached loosely to the liquid droplet jetting surface, whereby liquid leakage is liable to occur. In view of this, if a part of the first nozzle group 33 (the second nozzle group 53) is deviated with respect to the secondary scanning direction as in the embodiment, then it is possible to increase the rigidity of the cap member as will be explained below.

Figure 5:
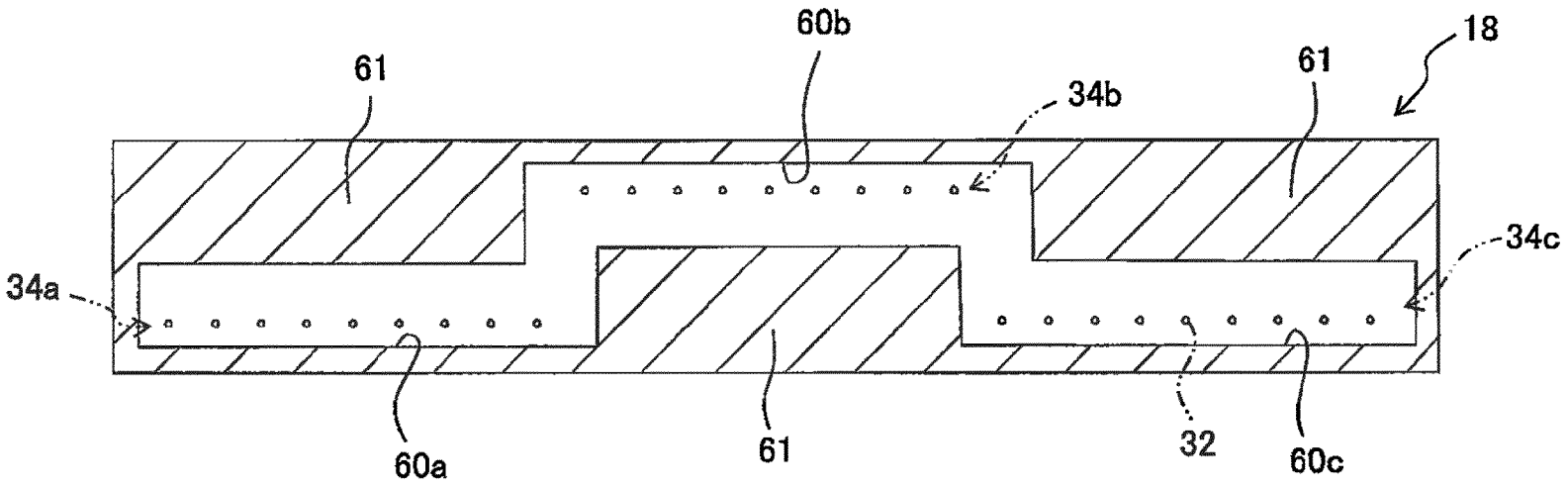
FIG. 5 is a top view of a cap member.

As shown in FIG. 5, in the cap member 18, three recesses 60 (60*a*, 60*b* and 60*c*) are formed to cover the three divisional nozzle groups 34*a* to 34*c* respectively, and these three recesses 60*a* to 60*c* are in connection with each other. Here, since there is positional deviation between the adjacent divisional nozzle groups 34 with respect to the secondary scanning direction, the recesses 60 also have positional deviations with respect to the secondary scanning direction. Therefore, it is possible to increase the thickness of portions 61 adjacent to the recesses 60 in the secondary scanning direction. By virtue of this, the rigidity of the whole cap member 18 increases, thereby improving its closeness or airtightness when it is pressed against the first head unit 11. This fact is the same for the cap member 19 of the second head unit 12.

Further, in order for the line-type ink-jet head to jet ink to the transported incoming recording paper 100 over the entire range in the width direction, it is necessary to have a number of nozzles aligned in one direction, and hence the head is liable to have an elongated shape. That is, the problems pointed out in the above are especially liable to occur in the line-type ink-jet head. Therefore, for the line-type ink-jet head 2, there is a great significance in dividing the one first nozzle group 33 (53) into the three divisional nozzle groups 34 (54) having positional deviations with respect to the secondary scanning direction.

However, as shown in FIG. 2, in each of the head units 11 and 12, the positional deviation with respect to the secondary scanning direction between the divisional nozzle groups 34*a* and 34*c* (54*a* and 54*c*) and the divisional nozzle group 34*b* (54*b*) means that the timings of jetting ink to the recording paper 100 are different between these two categories of divisional nozzle groups.

In particular, in the first head unit 11, ink is jetted by the central divisional nozzle group 34*b* positioned on the upstream side with respect to the secondary scanning direction (the transport direction) first, and then ink is jetted by the two divisional nozzle groups 34*a* and 34*c*. Further, the three divisional nozzle groups 34*a* to 34*c* are in communication with the common manifold 38. In the second head unit 12, ink is jetted by the two divisional nozzle groups 54*a* and 54*c* positioned on the upstream side with respect to the secondary scanning direction (the transport direction) first, and then ink is jetted by the central divisional nozzle group 54*b*. Further, the three divisional nozzle groups 54*a* to 54*c* are in communication with the common manifold 58.

The divisional nozzle group 34*b* which jets ink firstly jets ink with no ink flow occurring in the manifold 38. However, the two divisional nozzle groups 34*a* and 34*c* which jet ink secondly jet ink with an ink flow occurring in the manifold 38 due to the preceding ink jetting by the divisional nozzle group 34*b*. Therefore, compared with the ink jetting by the divisional nozzle group 34*b*, a greater pressure loss occurs at the time of supplying the ink to the nozzles 32 in the ink jetting by the two divisional nozzle groups 34*a* and 34*c*. Accordingly, a delay occurs in supplying the ink to the nozzles 32, thereby resulting in a decrease in liquid droplet quantity of the ink jetted from the two divisional nozzle groups 34*a* and 34*c*. This brings about a difference in darkness or shade between the dots formed on the recording paper 100 by the divisional nozzle group 34*b* and the dots formed on the recording paper 100 by the two divisional nozzle groups 34*a* and 34*c*.

However, in the first head unit 11 and the second head unit 12 of the embodiment, the central divisional nozzle groups 34*b* and 54*b* deviate respectively from the divisional nozzle groups 34*a* and 54*a* (34*c* and 54*c*) in opposite orientations along the secondary scanning direction. That is, in the first nozzle group 33 and the second nozzle group 53, there is such a relation of arrangement as the pair of the central divisional nozzle groups 34*b* and 54*b* are far from each other while the pair of the left divisional nozzle groups 34*a* and 54*a*, as well as the pair of the right divisional nozzle groups 34*c* and 54*c*, are close to each other. Therefore, in the first head unit 11, dark color dots are formed by the central divisional nozzle group 34*b* while light color dots are formed by the two divisional nozzle groups 34*a* and 34*c* on the left side and on the right side. On the contrary, in the second head unit 12, light color dots are formed by the central divisional nozzle group 54*b* while dark color dots are formed by the two divisional nozzle groups 54*a* and 54*c* on the left side and on the right side. That is, dots of mutually different shades are formed between the pair of the central divisional nozzle groups 34*b* and 54*b*, the pair of the left divisional nozzle groups 34*a* and 54*a*, and the pair of the right divisional nozzle groups 34*c* and 54*c*, which are arranged respectively in the secondary scanning direction.

Figures 6A, 6B, 6C, 6D:
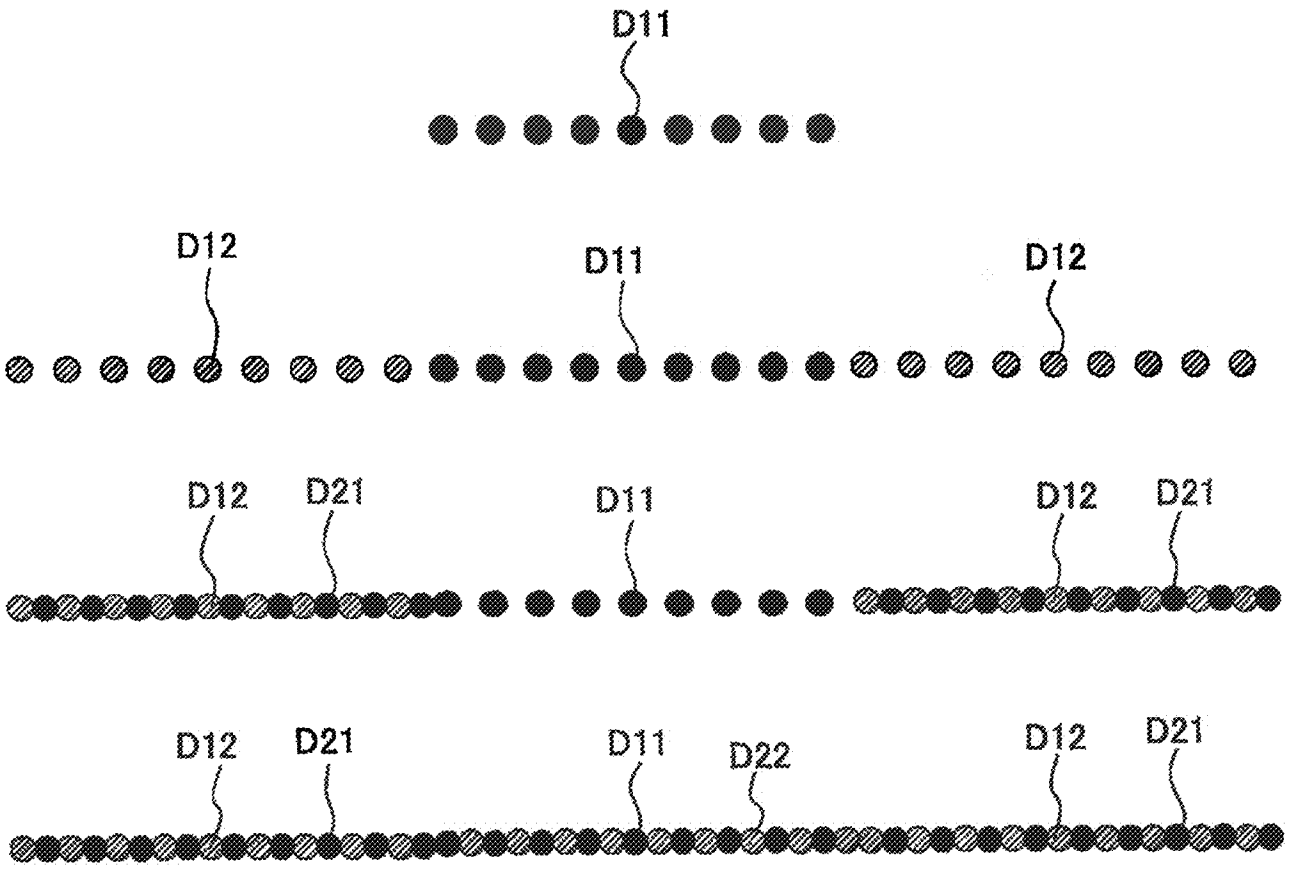
FIGS. 6A to 6D show landing conditions of liquid droplets on a sheet of recording paper when ink is jetted from the two head units.

Referring to FIGS. 6A to 6D, further explanations will be made for the foregoing description. When the recording paper 100 is transported toward the ink-jet head 2 in the secondary scanning direction, ink is jetted from the first head unit 11. First, the ink is jetted from the divisional nozzle group 34*b* positioned on the upstream side with respect to the secondary scanning direction to form a plurality of dark color dots D11 on the recording paper 100 as shown in FIG. 6A. Next, the ink is jetted respectively from the two divisional nozzle groups 34*a* and 34*c* to form a plurality of light color dots D12 respectively on both sides of the plurality of dots D11 formed previously as shown in FIG. 6B.

Further, as the recording paper 100 is still transported, ink is jetted subsequently from the second head unit 12. At this time, first, the ink is jetted from the two divisional nozzle groups 54*a* and 54*c* to fowl dark color dots D21 between the light color dots D12 formed by the divisional nozzle groups 34*a* and 34*c* of the first head unit 11 as shown in FIG. 6C. Afterwards, the ink is jetted from the central divisional nozzle group 54*b* to form light color dots D22 between the dark color dots D11 formed by the divisional nozzle group 34*b* of the first head unit 11 as shown in FIG. 6D.

In this manner, by the first nozzle group 33 of the first head unit 11 and the second nozzle group 53 of the second head unit 12, one dot row is formed on the recording paper 100 such that the dark color dots (D11 and D21) and the light color dots (D12 and D22) are alternately disposed. That is, the light color dots and the dark color dots are mutually dispersed such that color shading becomes less noticeable.

As explained hereinbefore, in the ink-jet head 2 of the embodiment, the nozzles 32 constituting the first nozzle group 33 of the first head unit 11 and the nozzles 52 constituting the second nozzle group 53 of the second head unit 12 are arranged alternately with respect to the main scanning direction to complement each other. Further, the first nozzle group 33 and the second nozzle group 53 are divided into the three divisional nozzle groups 34 and the three divisional nozzle groups 54, respectively. Moreover, the orientation in which the central divisional nozzle group 34*b* of the first nozzle group 33 deviates from the other divisional nozzle groups 34*a* and 34*c* of the first nozzle group 33 with respect to the secondary scanning direction is opposite to the orientation in which the central divisional nozzle group 54*b* of the second nozzle group 53 deviates from the divisional nozzle groups 54*a* and 54*c* of the second nozzle group 53 with respect to the secondary scanning direction. By virtue of this configuration, the divisional nozzle group(s) for the preceding jetting timing in one of the first nozzle group 33 and the second nozzle group 53 complement(s) the divisional nozzle group(s) for the succeeding jetting timing in the other of the first nozzle group 33 and the second nozzle group 53. Thus, in the one dot row formed on the recording paper 100 by the first nozzle group 33 and the second nozzle group 53, the dark dots and light dots are alternately aligned, and thereby color shading becomes less noticeable in that one dot row.

The first nozzle group 33 of the first head unit 11 is divided into the three (an odd number of) divisional nozzle groups 34 and, correspondingly, the three piezoelectric actuators 31 are provided. Further, the second nozzle group 53 is also divided into the three (an odd number of) divisional nozzle groups 54 and, correspondingly, the three piezoelectric actuators 51 are provided. In this case, it is possible to make the flow passage structures of the flow passage units 30 and the arrangement of the piezoelectric actuators 31 of the first head unit 11 and the flow passage structures of the flow passage units 50 and the arrangement of the piezoelectric actuators 51 of the second head unit 12 point symmetry. Further, the point symmetry relationship refers to a relationship in which the flow passage structures and arrangement of the actuators are congruent between the two head units 11 and 12 when one head unit has been turned 180 degrees with respect to the other within a horizontal plane. By virtue of this, between the first head unit 11 and the second head unit 12, it is possible to commonalize the components constituting the flow passage units 30 and 50 and the piezoelectric actuators 31 and 51. Furthermore, it is also possible to constitute the first head unit 11 and the second head unit 12 by preparing two head units of an identical structure, and arranging them to be aligned with one head unit in such a posture as it is turned 180 degrees with respect to the other head unit within the horizontal plane. By virtue of this, it is possible to reduce the number of component types and lower the fabrication cost.

Next, explanations will be made with respect to a few modifications which apply various changes to the above embodiment. Note that, however, the same reference numerals will be used to refer to the same components in terms of configuration as those in the above embodiment, any explanation of which will be omitted as appropriate.

Figure 12:
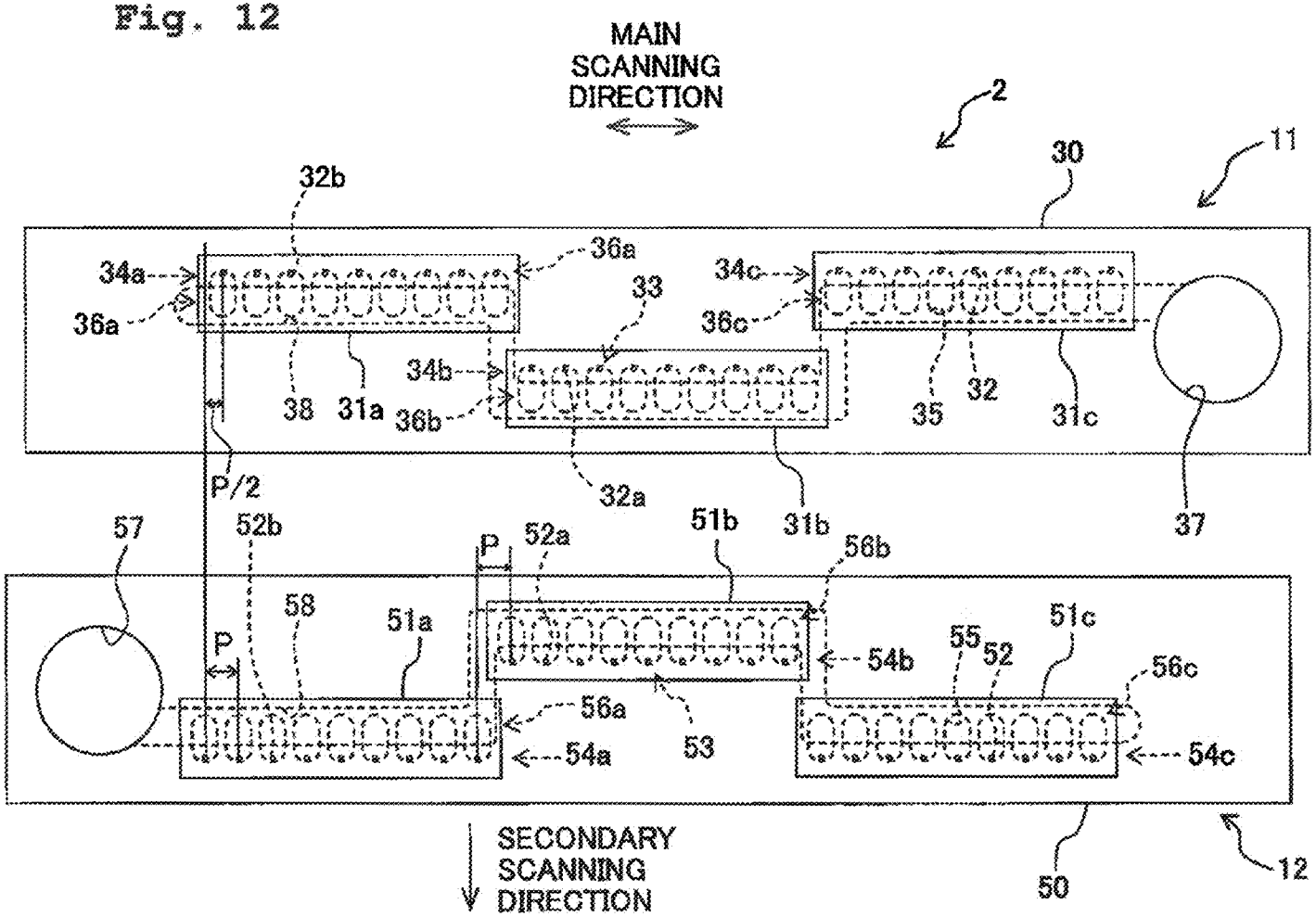
FIG. 12 is a plan view of an ink-jet head according to fifth modification.

In the above embodiment, the first nozzle group 33 and the second nozzle group 53 are divided into the three divisional nozzle groups 34*a* to 34*c* and the three divisional nozzle groups 54*a* to 54*c*, respectively. The central divisional nozzle group 34*b* of the first nozzle group 33 deviates from the two divisional nozzle groups 34*a* and 34*c* to the upstream side with respect to the secondary scanning direction (to the upper side of FIG. 2), and the central divisional nozzle group 54*b* of the second nozzle group 53 deviates from the two divisional nozzle groups 54*a* and 54*c* to the downstream side with respect to the secondary scanning direction (to the lower side of FIG. 2). However, the orientations of deviations of the central divisional nozzle group 34*b* and the central divisional nozzle group 54*b* are not limited to the above orientations. As shown in FIG. 12, for example, the central divisional nozzle group 34*b* of the first nozzle group 33 may deviate from the two divisional nozzle groups 34*a* and 34*c* to the downstream side with respect to the secondary scanning direction (to the lower side of FIG. 12), and the central divisional nozzle group 54*b* of the second nozzle group 53 may deviate from the two divisional nozzle groups 54*a* and 54*c* to the upstream side with respect to the secondary scanning direction (to the upper side of FIG. 12) (fifth modification). In this configuration, the divisional nozzle groups 34*a* and 34*c* for the preceding jetting timing in the first nozzle group 33 still complement the divisional nozzle groups 54*a* and 54*c* for the succeeding jetting timing in the second nozzle group 53, and the divisional nozzle group 34*b* for the succeeding jetting timing in the first nozzle group 33 still complements the divisional nozzle group 54*b* for the preceding jetting timing in the second nozzle group 53. Thus, in one dot row formed on the recording paper 100 by the first nozzle group 33 and the second nozzle group 53, the dark dots and light dots are alternately aligned, and thereby color shading becomes less noticeable in that one dot row. Assuming that any nozzle 32 included in the divisional nozzle groups 34*a* or 34*c* corresponds to the first nozzle of the present invention, any nozzle 32 included in the divisional nozzle group 34*b* corresponds to the second nozzle of the present invention. On the other hand, assuming that any nozzle 32 included in the divisional nozzle group 34*b* corresponds to the first nozzle of the present invention, any nozzle 32 included in the divisional nozzle groups 34*a* or 34*c* corresponds to the second nozzle of the present invention. Further, presuming that any one nozzle 32*a* included in the divisional nozzle group 34*a* or 34*c* corresponds to the first nozzle of the present invention, and any one nozzle 32*b* included in the divisional nozzle group 34*b* corresponds to the second nozzle of the present invention, a nozzle 52*a* included in the divisional nozzle group 54*a* or 54*c* and adjacent to the nozzle 32*a* with respect to the main scanning direction corresponds to the third nozzle of the present invention, and a nozzle 52*b* included in the divisional nozzle group 54*b* and adjacent to the nozzle 32*b* with respect to the main scanning direction corresponds to the fourth nozzle of the present invention. On the other hand, presuming that any one nozzle 32*a* included in the divisional nozzle group 34*b* corresponds to the first nozzle of the present invention, and any one nozzle 32*b* included in the divisional nozzle group 34*a* or 34*c* corresponds to the second nozzle of the present invention, a nozzle 52*a* included in the divisional nozzle group 54*b* and adjacent to the nozzle 32*a* with respect to the main scanning direction corresponds to the third nozzle of the present invention, and a nozzle 52*b* included in the divisional nozzle group 54*a* or 54*c* and adjacent to the nozzle 32*b* with respect to the main scanning direction corresponds to the fourth nozzle of the present invention.

In the above embodiment, inside the first flow passage unit 30, the manifold 38 extends from the left end portion of the first flow passage unit 30 at which the ink supply port 37 is formed, toward the right end portion in the main scanning direction, so as to communicate with all of the first pressure chambers 35. Likewise, inside the second flow passage unit 50, the manifold 58 extends from the right end portion of the second flow passage unit 50 at which the ink supply port 57 is formed, toward the left end portion in the main scanning direction, so as to communicate with all of the second pressure chambers 55. However, without being limited to this configuration, inside the first flow passage unit 30, alternatively it is possible to provide three sub manifolds in respective communication with the three pressure chamber groups 36*a* to 36*c*, and a connective manifold for making these three sub manifolds communicate with the ink supply port 37. In this case, a manifold constituted by the connective manifold and the three sub manifolds corresponds to a first common ink chamber of the present invention. Likewise, inside the second flow passage unit 50, alternatively it is possible to provide three sub manifolds in respective communication with the three pressure chamber groups 56*a* to 56*c*, and a connective manifold for making these three sub manifolds communicate with the ink supply port 57. In this case, a manifold constituted by the connective manifold and the three sub manifolds corresponds to a second common ink chamber of the present invention.

Figure 7:
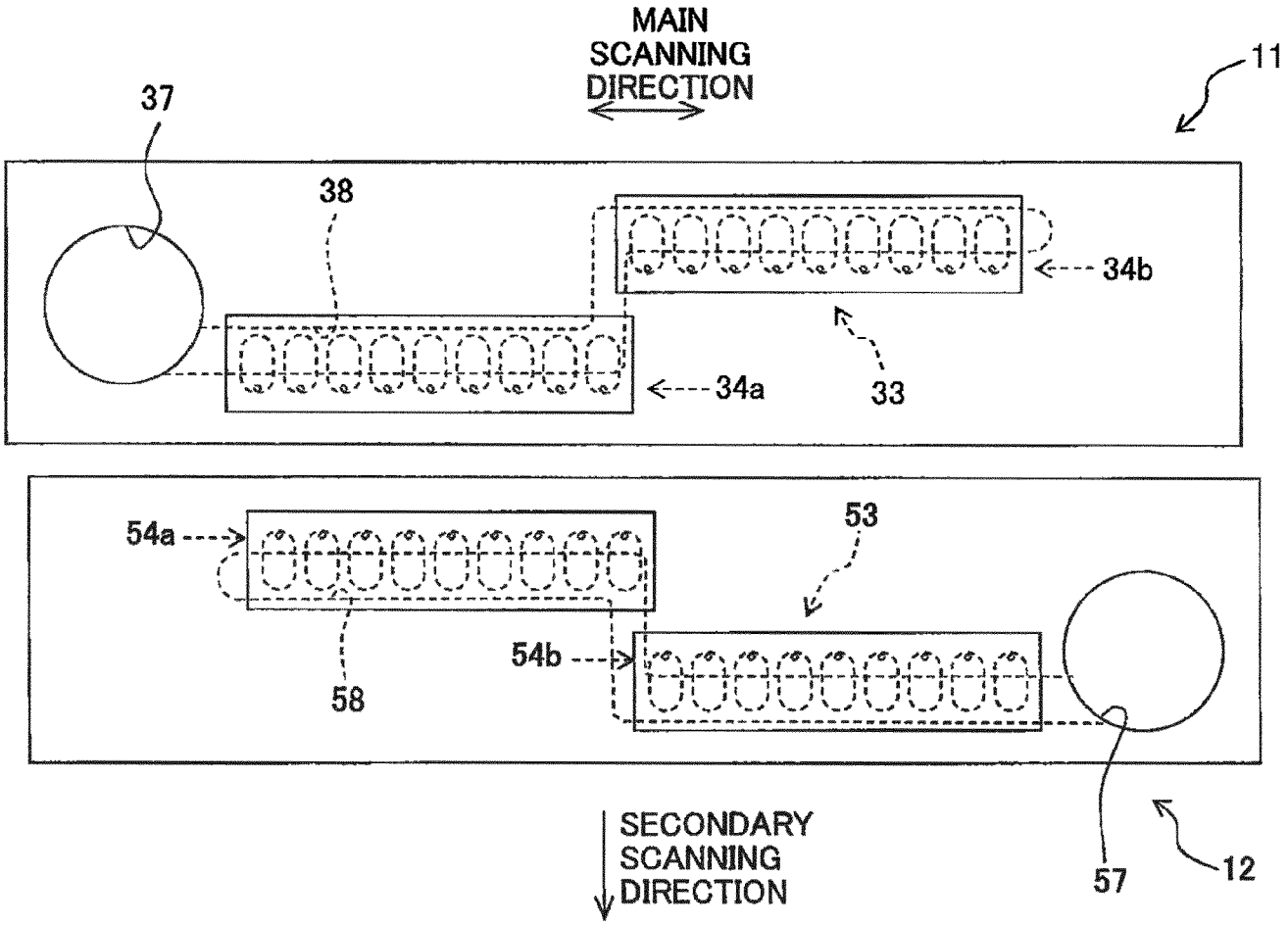
FIG. 7 is a plan view of an ink-jet head according to first modification.

In the above embodiment, the first nozzle group 33 (the second nozzle group 53) is divided into the three divisional nozzle groups 34 (54). However, the division number is not limited to three, but may also be either any even number or any odd number not less than five. As shown in FIG. 7, for example, it may be divided into two divisional nozzle groups 34*a* and 34*b* (54*a* and 54*b*) (first modification).

Figure 8:
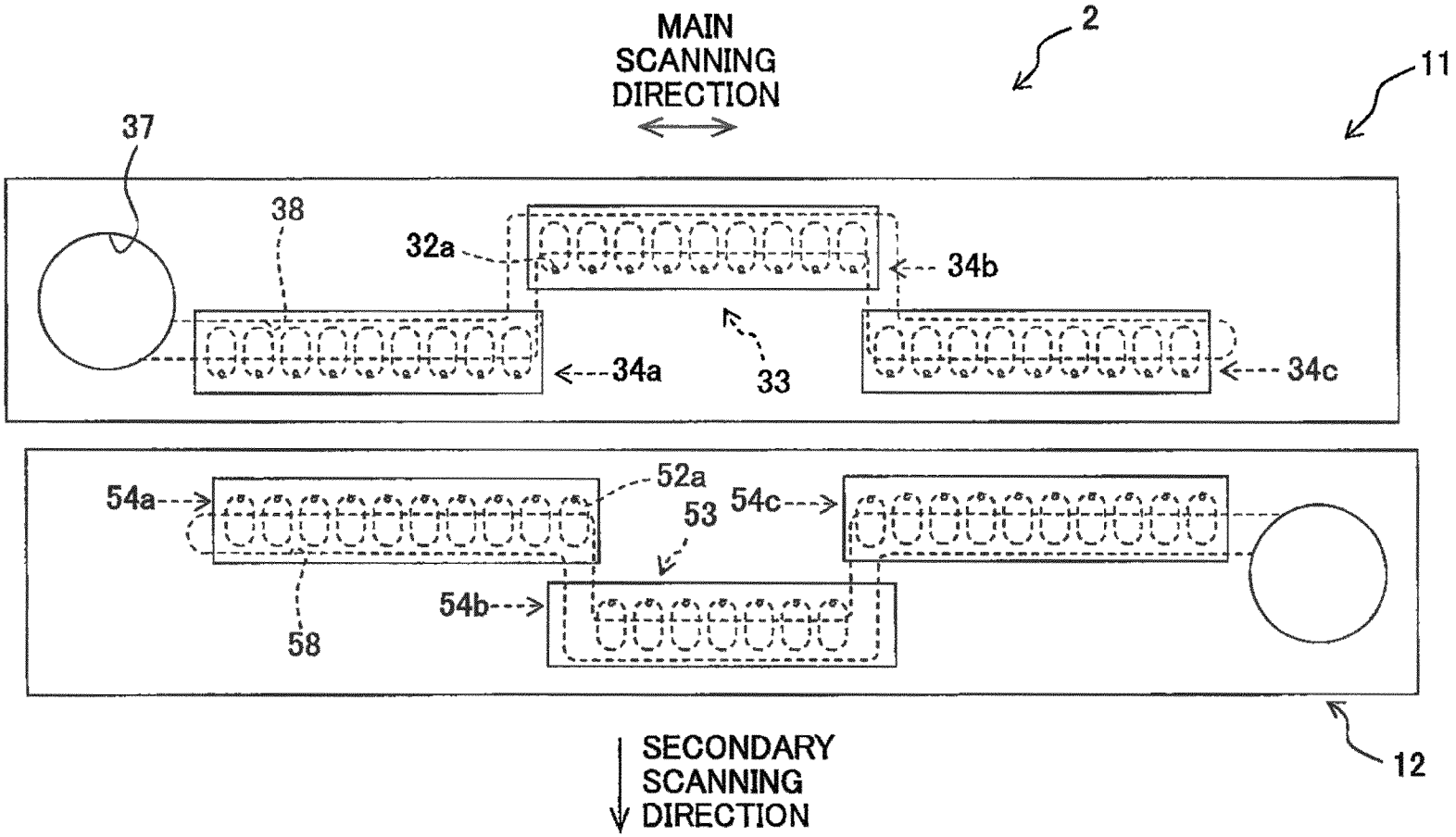
FIG. 8 is a plan view of an ink-jet head according to second modification.
Figure 11A:
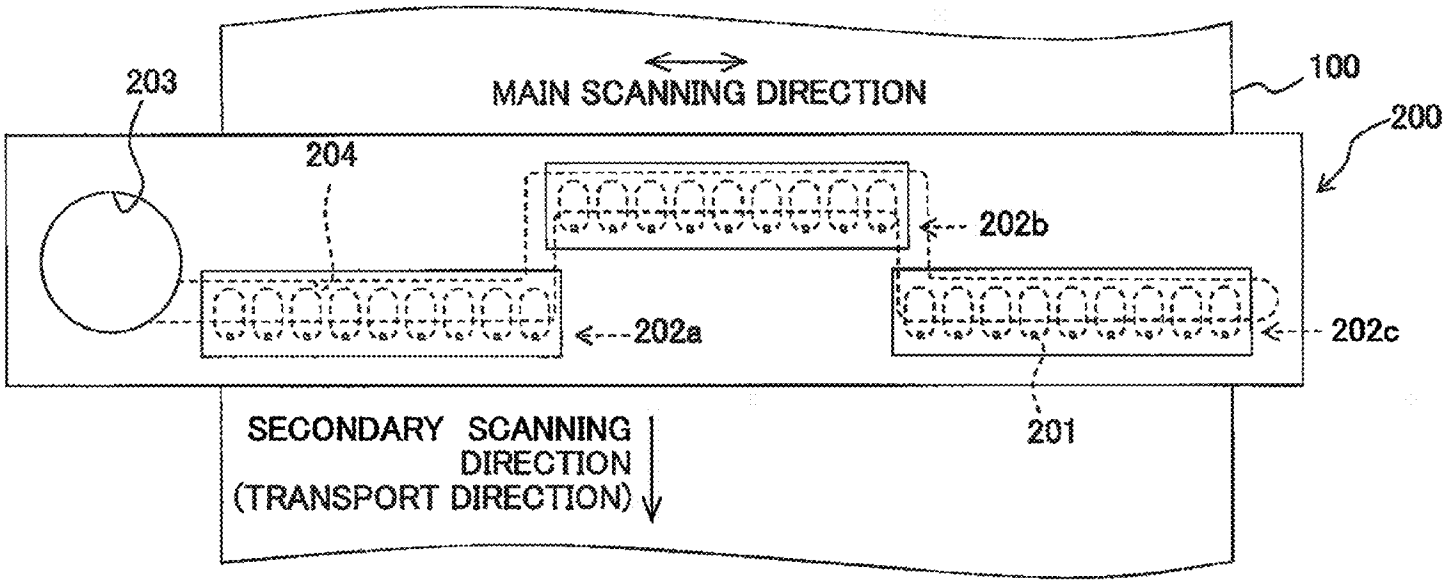
FIG. 11A is a plan view of an ink-jet head having a configuration of a plurality of divisional nozzle groups connected to one common ink chamber.
Figure 11B:
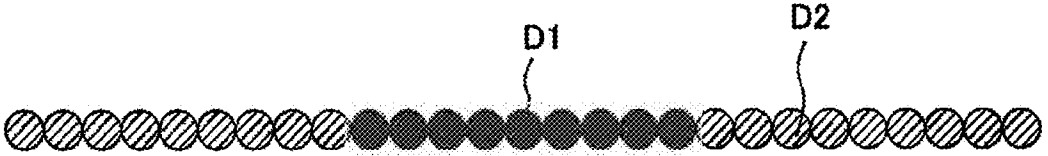
FIG. 11B shows a dot row formed by the ink-jet head of FIG. 11A.

It is not necessary for the number of nozzles to be equal between the divisional nozzle groups 34 and 54 of the first nozzle group 33 and the second nozzle group 53 arranged in the secondary scanning direction. For example, as shown in FIG. 8, the number of nozzles of the central divisional nozzle group 54*b* of the second nozzle group 53 is smaller than that of the central divisional nozzle group 34*b* of the first nozzle group 33 (second modification). In this case, as in FIG. 8, with respect to the main scanning direction, the two nozzles 32*a* of the divisional nozzle group 34*b* from the left are adjacent to the two nozzles 52*a* of the divisional nozzle group 54*a* from the right, and the rightmost nozzle 32*a* of the divisional nozzle group 34*b* is adjacent to the leftmost nozzle 52*a* of the divisional nozzle group 54*c*. However, the divisional nozzle group 34*b* is positioned on the upstream side in the first head unit 11 with respect to the secondary scanning direction, and the divisional nozzle groups 54*a* and 54*c* are also positioned on the upstream side in the second head unit 12 with respect to the secondary scanning direction. Therefore, in forming a dot row on the recording paper 100, consecutive dark color dots are formed by jetting from the two nozzles 32*a* of the divisional nozzle group 34*b* from the left, the two nozzles 52*a* of the divisional nozzle group 54*a* from the right, the rightmost nozzle 32*a* of the divisional nozzle group 34*b*, and the leftmost nozzle 52*a* of the divisional nozzle group 54*c*. However, because the color shades are mutually dispersed in the dot row as a whole, it can be said that color shading is considerably less noticeable than the case of FIG. 11B.

Figure 9A:
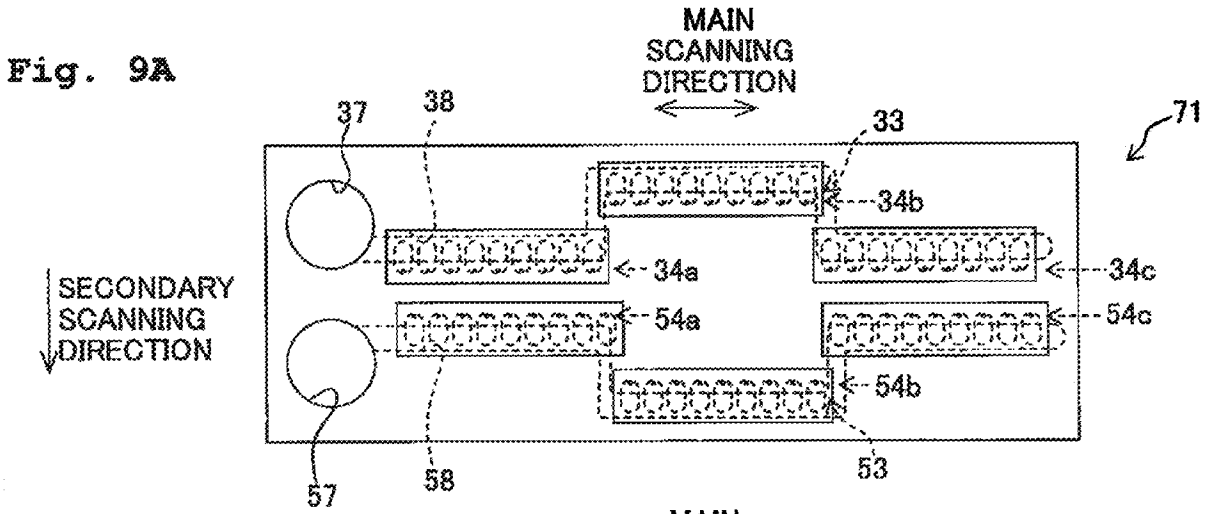
FIGS. 9A and 9B are plan views of ink-jet heads according to third modification.
Figure 9B:
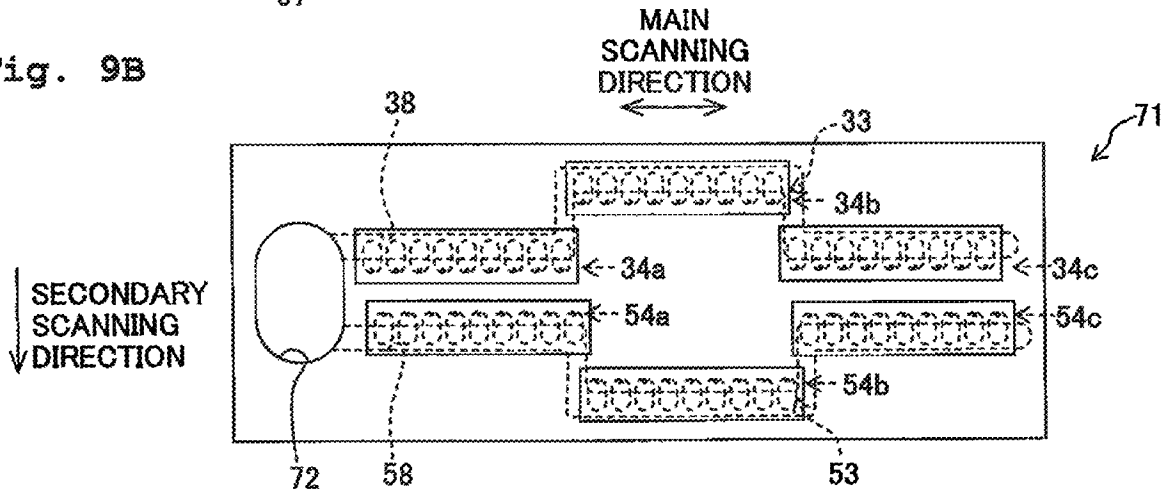

As shown in FIGS. 9A and 9B, a single head unit 71 may have the first nozzle group 33 and the second nozzle group 53 (third modification). As shown in FIG. 9A, the manifold 38 in communication with the first nozzle group 33 and a manifold 58 in communication with the second nozzle group 53 may communicate with two different ink supply ports 37 and 57 respectively. Alternatively, as shown in FIG. 9B, the two manifolds 38 and 58 may communicate with a common ink supply port 72. In the configuration of FIG. 9B, because the manifolds 38 and 58 are independent of each other between the first nozzle group 33 and the second nozzle group 53, the ink jetting by the first nozzle group 33 exerts almost no influence on the ink jetting by the second nozzle group 53. The reason is that even if an ink flow occurs in the manifold 38 due to the ink jetting by the first nozzle group 33, no ink may flow into the manifold 58 as long as no ink is jetted from the second nozzle group 53, and thus almost no ink flow may occur in the manifold 58 in communication with the second nozzle group 53.

In the above embodiment, the present invention is applied to the so-called line-type ink-jet head as an example, it is also possible to apply the present invention to a so-called serial-type ink-jet head which jets ink to the recording paper 100 being transported while moving in a predetermined direction. In an example shown in FIG. 10, a serial-type ink-jet head 82 is installed on a carriage 80 capable of reciprocating movement along two guide rails 83 and 84 in a scanning direction perpendicular to the transport direction of the recording paper 100. Then, the ink-jet head 82 jets ink toward the recording paper 100 while moving along with the carriage 80 in the scanning direction (fourth modification).

Figure 10:
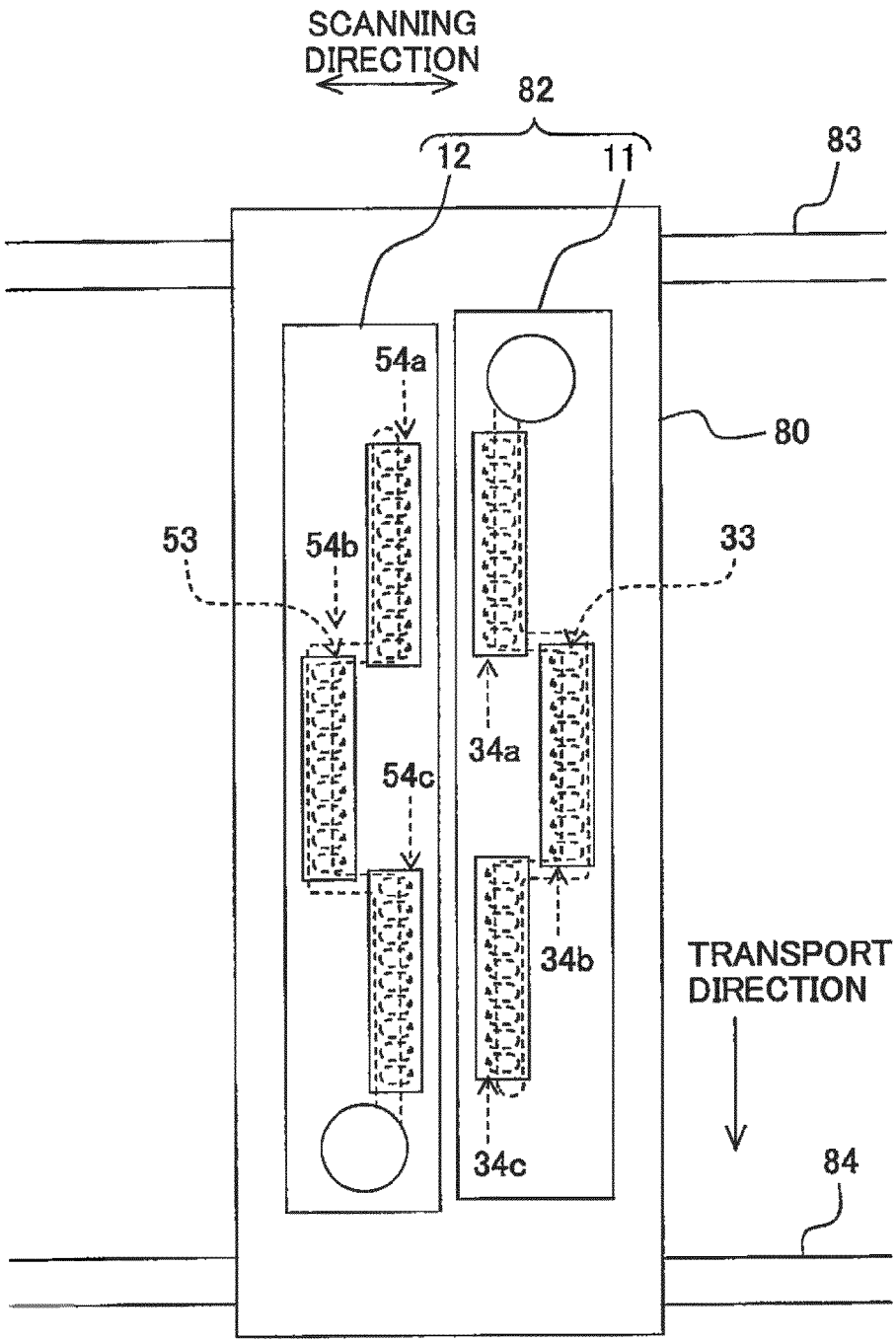
FIG. 10 is a plan view of a serial-type ink-jet head according to fourth modification.

Comparing this modification shown in FIG. 10 with the above embodiment shown in FIG. 2, it is different from the above embodiment only in that nozzle arrangement direction in the first nozzle group 33 and nozzle arrangement direction in the second nozzle group 53 are parallel to the transport direction of the recording paper 100 (the secondary scanning direction in FIG. 2). Except that, all is the same as in FIG. 2. Therefore, this modification achieves almost the same effect as the above embodiment. That is, when the first nozzle group 33 and the second nozzle group 53 form a dot row parallel to the transport direction on the recording paper 100, dark color dots and light color dots are disposed alternately in the dot row. Therefore, color shading becomes less noticeable when occurring in the dot row due to the respective division of the nozzle groups 33 and 53 into the plurality of divisional nozzle groups 34 and 54.

Figure 13A:
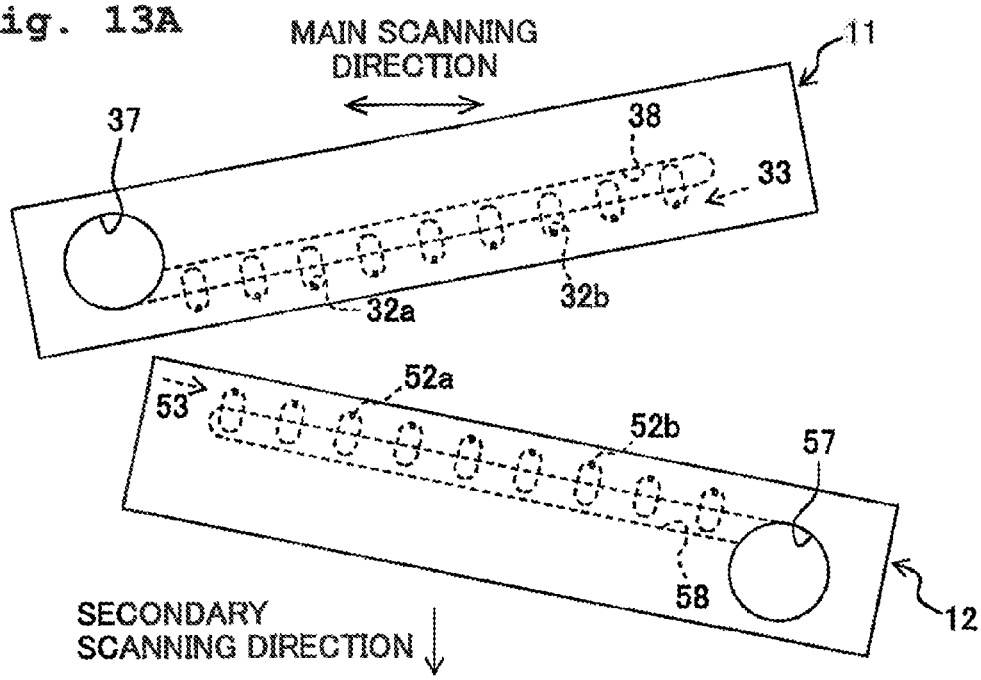
FIGS. 13A and 13B are plan views of two head units of an ink-jet head according to sixth modification.
Figure 13B:
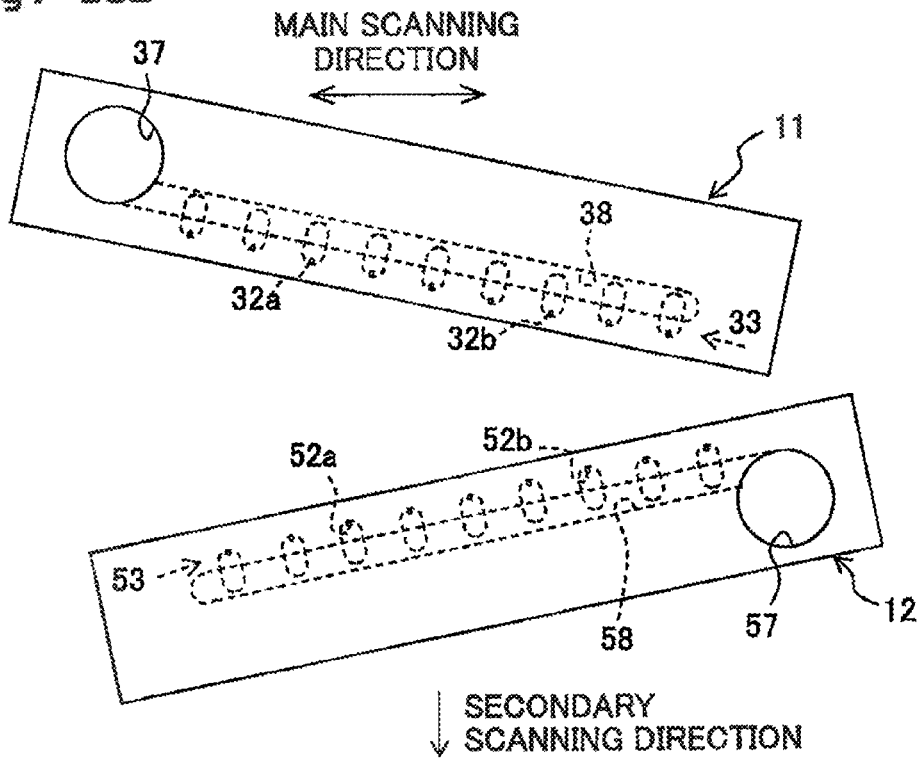

In the ink-jet head 2 of the above embodiment, the nozzles 32 constituting the first nozzle group 33 of the first head unit 11 are divided into the three divisional nozzle groups 34*a* to 34*c*, and the nozzles 32 constituting each divisional nozzle group are aligned in the main scanning direction. Likewise, the nozzles 52 constituting the second nozzle group 53 of the second head unit 12 are divided into the three divisional nozzle groups 54*a* to 54*c*, and the nozzles 52 constituting each divisional nozzle group are aligned in the main scanning direction. However, the nozzles 32 constituting the first nozzle group 33 and the nozzles 52 constituting the second nozzle group 53 are not limited to this alignment. As shown in FIG. 13A (sixth modification), for example, the first head unit 11 and the second head unit 12 may be arranged to incline with respect to the main scanning direction so that: the nozzles 32 constituting the first nozzle group 33 and the nozzles 52 constituting the second nozzle group 53 are arranged alternately with respect to the main scanning direction to complement each other; the nozzles 32 constituting the first nozzle group 33 are aligned in a direction inclined to the upstream side (the upper side of FIG. 13A) in the secondary scanning direction with respect to the main scanning direction (corresponding to a third direction of the present invention); and the nozzles 52 constituting the second nozzle group 53 arc aligned in a direction inclined to the downstream side (the lower side of FIG. 13A) in the secondary scanning direction from the main scanning direction (corresponding to a fourth direction of the present invention). Alternatively, as shown in FIG. 13B, the first head unit 11 and the second head unit 12 may be arranged to incline with respect to the main scanning direction so that: the nozzles 32 constituting the first nozzle group 33 and the nozzles 52 constituting the second nozzle group 53 are arranged alternately with respect to the main scanning direction to complement each other; the nozzles 32 constituting the first nozzle group 33 are aligned in a direction inclined to the downstream side (the lower side of FIG. 13B) in the secondary scanning direction with respect to the main scanning direction (corresponding to the third direction of the present invention); and the nozzles 52 constituting the second nozzle group 53 are aligned in a direction inclined to the upstream side (the upper side of FIG. 13B) in the secondary scanning direction with respect to the main scanning direction (corresponding to the fourth direction of the present invention).

For example, in a dot row formed by the first head unit 11 shown in FIG. 13A, the darkness or shade of the dots becomes deeper from one side (the left side of FIG. 13A) to the other side (the right side of FIG. 13A) along the main scanning direction, and in a dot row formed by the second head unit 12 shown in FIG. 13A, the shade of the dots becomes deeper from the other side (the right side of FIG. 13A) to the one side (the left side of FIG. 13A) along the main scanning direction. Therefore, when one dot row is formed by the dots jetted from the first head unit 11 and the second head unit 12, the dark dots formed by the first head unit 11 and the light dots formed by the second head unit 12 complement each other, and the light dots formed by the first head unit 11 and the dark dots formed by the second head unit 12 complement each other. Thus, in the one dot row formed on the recording paper 100 by the dots jetted from the first head unit 11 and the second head unit 12, the dark dots and light dots are alternately aligned, and thereby color shading becomes less noticeable in that one dot row. Then, in the configuration shown in FIG. 13B, it is also possible to achieve the same effect as in the configuration shown in FIG. 13A.

In FIG. 13A, for example, assuming that a nozzle 32*a* of the first nozzle group 33 on one side (the left side of FIG. 13A) in the main scanning direction corresponds to the first nozzle of the present invention, a nozzle 32*b* on the other side with respect to the nozzle 32*a* (the right side of FIG. 13A) in the main scanning direction corresponds to the second nozzle of the present invention. Then, in the second nozzle group 53, a nozzle 52*a* adjacent to the nozzle 32*a* with respect to the main scanning direction corresponds to the third nozzle of the present invention, and a nozzle 52*b* adjacent to the nozzle 32*b* with respect to the main scanning direction corresponds to the fourth nozzle of the present invention. In this case, the nozzle 32*b* corresponding to the second nozzle of the present invention deviates from the nozzle 32*a* corresponding to the first nozzle of the present invention to the upstream side (to the upper side of FIG. 13A) with respect to the secondary scanning direction, and the nozzle 52*b* corresponding to the fourth nozzle of the present invention deviates from the nozzle 52*a* corresponding to the third nozzle of the present invention to the downstream side (to the lower side of FIG. 13A) with respect to the secondary scanning direction. That is, with respect to the secondary scanning direction, the orientation in which the nozzle 52*b* deviates from the nozzle 52*a* is opposite to the orientation in which the nozzle 32*b* deviates from the nozzle 32*a*. Then, in analogy with the configuration of FIG. 13A, the corresponding relationship between the first nozzle to the fourth nozzle of the present invention also holds for the configuration of FIG. 13B (sixth modification).

Figure 14A:
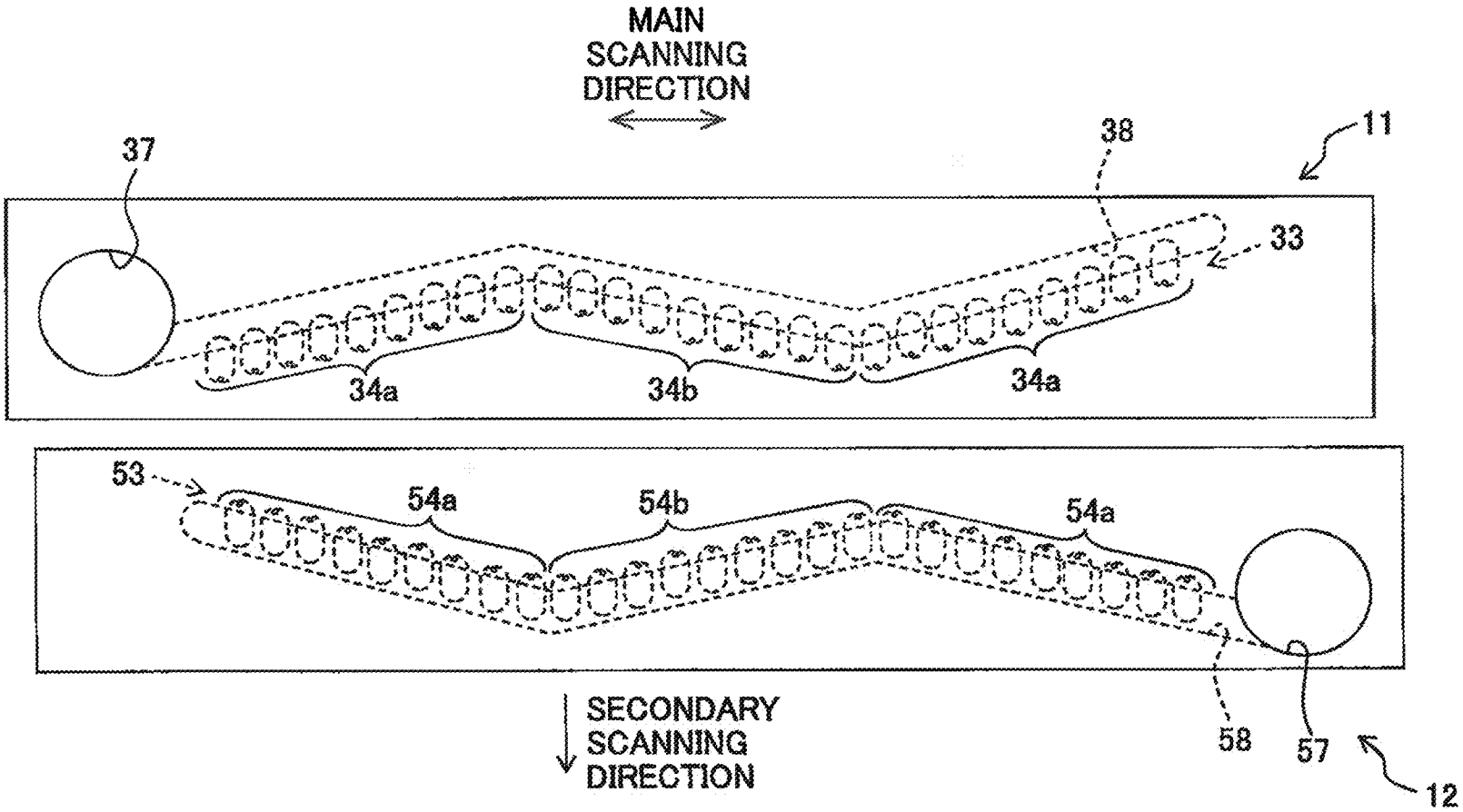
FIGS. 14A and 14B are plan views of two head units of an ink-jet head according to seventh modification.
Figure 14B:
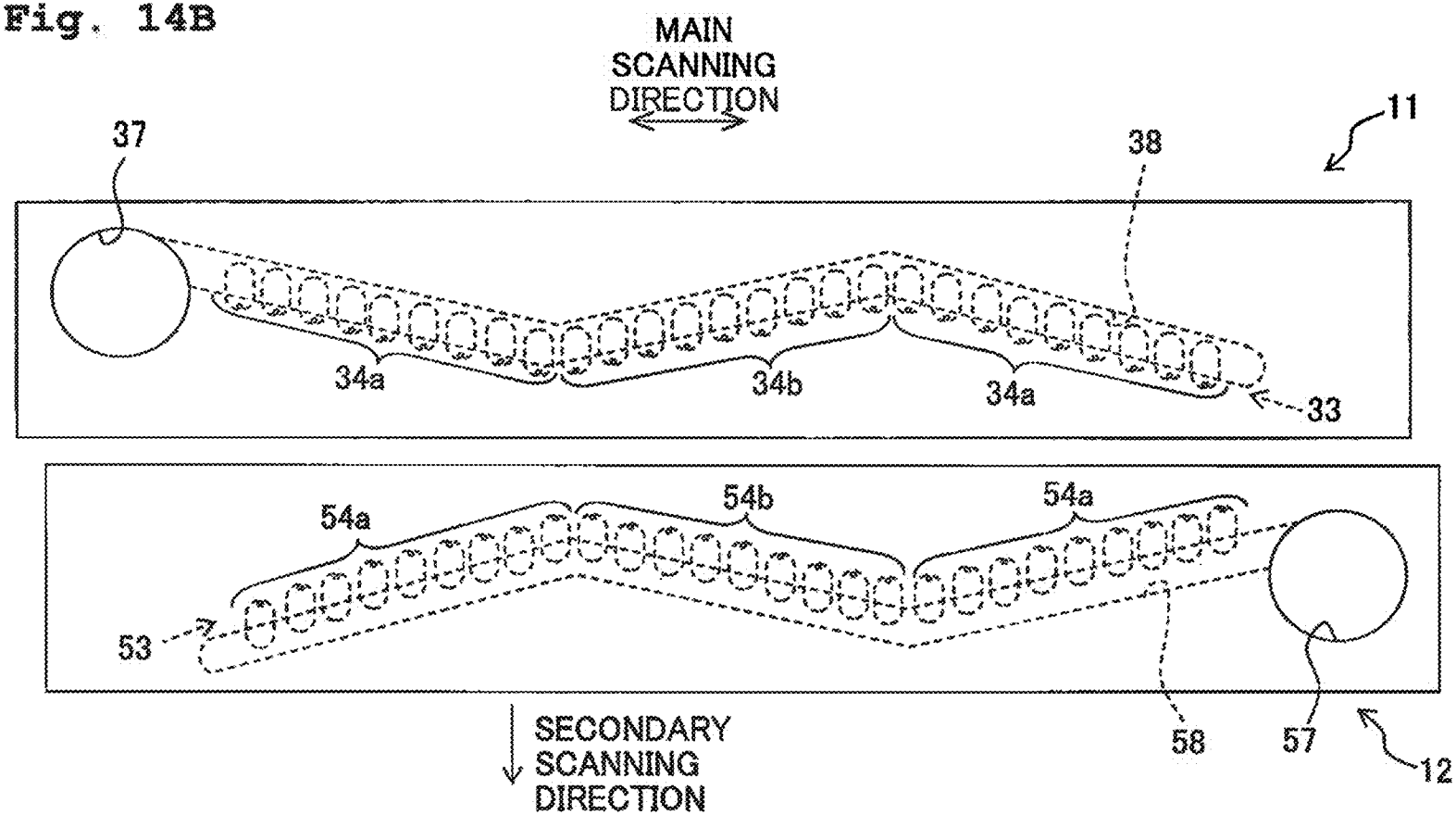

Further, as shown in FIG. 14A, the nozzles 32 constituting the first nozzle group 33 and the nozzles 52 constituting the second nozzle group 53 may be arranged alternately with respect to the main scanning direction to complement each other. The nozzles 32 constituting the first nozzle group 33 may be divided into first divisional nozzle group 34*a*, in which the nozzles 32 are aligned in a direction inclined to the upstream side (the upper side in FIG. 14A) in the secondary scanning direction with respect to the main scanning direction, and second divisional nozzle group 34*b*, in which the nozzles 32 are aligned in a direction inclined to the downstream side (the lower side in FIG. 14A) in the secondary scanning direction with respect to the main scanning direction. Similarly, the nozzles 52 constituting the second nozzle group 53 may be divided into third divisional nozzle group 54*a*, in which the nozzles 52 are aligned in a direction inclined to the downstream side (the lower side in FIG. 14A) in the secondary scanning direction with respect to the main scanning direction, and fourth divisional nozzle group 54*b*, in which the nozzles 52 are aligned in a direction inclined to the upstream side the upper side in FIG. 14A) in the secondary scanning direction with respect to the main scanning direction (seventh modification). Alternatively, as shown in FIG. 14B, the nozzles 32 constituting the first nozzle group 33 and the nozzles 52 constituting the second nozzle group 53 may be arranged alternately with respect to the main scanning direction to complement each other. The nozzles 32 constituting the first nozzle group 33 may be divided into first divisional nozzle group 34*a*, in which the nozzles 32 are aligned in a direction inclined to the downstream side (the lower side in FIG. 14B) in the secondary scanning direction with respect to the main scanning direction, and second divisional nozzle group 34*b*, in which the nozzles 32 are aligned in a direction inclined to the upstream side (the upper side in FIG. 14B) in the secondary scanning direction with respect to the main scanning direction. Similarly, the nozzles 52 constituting the second nozzle group 53 may be divided into third divisional nozzle group 54*a*, in which the nozzles 52 are aligned in a direction inclined to the upstream side (the upper side in FIG. 14B) in the secondary scanning direction with respect to the main scanning direction, and fourth divisional nozzle group 54*b*, in which the nozzles 52 are aligned in a direction inclined to the downstream side (the lower side in FIG. 14B) in the secondary scanning direction with respect to the main scanning direction (seventh modification).

What is claimed is:

1. An ink-jet head configured to jet ink, comprising:

a first nozzle group constituted by a plurality of nozzles which are arranged with intervals therebetween with respect to a first direction;

a second nozzle group constituted by a plurality of nozzles which are different from the nozzles constituting the first nozzle group and arranged with intervals therebetween with respect to the first direction;

a first common ink chamber which communicates commonly with the nozzles constituting the first nozzle group; and a second common ink chamber which communicates commonly with the nozzles constituting the second nozzle group;

wherein, with respect to the first direction, the nozzles constituting the first nozzle group and the nozzles constituting the second nozzle group are arranged alternately to complement each other;

wherein the first nozzle group includes:

a first nozzle; and a second nozzle which deviates from the first nozzle with respect to a second direction perpendicular to the first direction;

wherein the second nozzle group includes:

a third nozzle which is arranged adjacent to the first nozzle with respect to the first direction; and a fourth nozzle which is arranged adjacent to the second nozzle with respect to the first direction;

wherein, with respect to the second direction, the fourth nozzle deviates from the third nozzle in a direction opposite to a direction in which the second nozzle deviates from the first nozzle;

wherein the nozzles constituting the first nozzle group and the nozzles constituting the second nozzle group are aligned along the first direction, respectively;

wherein the first nozzle group is divided into:

a first divisional nozzle group; and a second divisional nozzle group which deviates from the first divisional nozzle group with resect to the second direction by arranging some of the nozzles constituting the first nozzle group to deviate from the other of the nozzles constituting the first nozzle group with respect to the second direction;

wherein the second nozzle group is divided into:

a third divisional nozzle group; and a fourth divisional nozzle group which deviates from the third divisional nozzle group with respect to the second direction by arranging some of the nozzles constituting the second nozzle group to deviate from the other of the nozzles constituting the second nozzle group with respect to the second direction;

wherein the first divisional nozzle group and the third divisional nozzle group, and the second divisional nozzle group and the fourth divisional nozzle group, are arranged in the second direction, respectively;

wherein, with respect to the second direction, a direction in which the second divisional nozzle group deviates from the first divisional nozzle group in the first nozzle group is opposite to a direction in which the fourth divisional nozzle group deviates from the third divisional nozzle group in the second nozzle group; and wherein the first nozzle belongs to the first divisional nozzle group, the second nozzle belongs to the second divisional nozzle group, the third nozzle belongs to the third divisional nozzle group, and the fourth nozzle belongs to the fourth divisional nozzle group.

2. The ink-jet head according to claim 1:

wherein the second divisional nozzle group is located farther away from the second nozzle group than the first divisional nozzle group with respect to the second direction; and wherein the fourth divisional nozzle group is located farther away from the first nozzle group than the third divisional nozzle group with respect to the second direction.

3. The ink-jet head according to claim 1, further comprising:

a first actuator configured to drive the first divisional nozzle group;

a second actuator configured to drive the second divisional nozzle group;

a third actuator configured to drive the third divisional nozzle group; and a fourth actuator configured to drive the fourth divisional nozzle group;

wherein the first actuator and the second actuator are arranged to deviate from each other with respect to the second direction in accordance with the arrangement of the first divisional nozzle group and the second divisional nozzle group; and wherein the third actuator and the fourth actuator are arranged to deviate from each other with respect to the second direction in accordance with the arrangement of the third divisional nozzle group and the fourth divisional nozzle group.

4. The ink-jet head according to claim 3:

wherein the ink-jet head is provided as:

a first head unit which has a first flow passage assembly in which ink flow passages are formed to include the first nozzle group and the first common ink chamber, and the first actuator and the second actuator which are provided to the first flow passage assembly; and a second head unit which is arranged side by side with the first head unit in the second direction, and which has a second flow passage assembly in which ink flow passages are formed to include the second nozzle group and the second common ink chamber, and the third actuator and the fourth actuator which are provided to the second flow passage assembly;

wherein the first nozzle group is divided into an odd number of divisional nozzle groups being not less than three groups and being constituted by the first divisional nozzle group and the second divisional nozzle group which are arranged alternately along the first direction;

wherein the second nozzle group is divided into the odd number of divisional nozzle groups being not less than three groups and being constituted by the third divisional nozzle group and the fourth divisional nozzle group which are arranged alternately along the first direction;

wherein, in the first head unit, an odd number of actuators not less than three actuators are constituted by the first actuator and the second actuator, and the first actuator and the second actuator are arranged alternately along the first direction in accordance with the arrangement of the first divisional nozzle group and the second divisional nozzle group; and wherein, in the second head unit, an odd number of actuators not less than three actuators are constituted by the third actuator and the fourth actuator, and the third actuator and the fourth actuator are arranged alternately along the first direction in accordance with the arrangement of the third divisional nozzle group and the fourth divisional nozzle group.

5. The ink-jet head according to claim 1:

wherein the ink is jetted from the first nozzle group and the second nozzle group to a recording medium which is transported in a direction intersecting the first direction in a state that the ink-jet head is fixed to a predetermined position.

6. The ink-jet head according to claim 1:

wherein, with respect to the first direction, the intervals between the nozzles constituting the first nozzle group are equal to the intervals between the nozzles constituting the second nozzle group.

7. An ink-jet head configured to jet ink, comprising:

a first nozzle group constituted by a plurality of nozzles which are arranged with intervals therebetween with respect to a first direction;

a second nozzle group constituted by a plurality of nozzles which are different from the nozzles constituting the first nozzle group and arranged with intervals therebetween with respect to the first direction;

a first common ink chamber which communicates commonly with the nozzles constituting the first nozzle group; and a second common ink chamber which communicates commonly with the nozzles constituting the second nozzle group;

wherein, with respect to the first direction, the nozzles constituting the first nozzle group and the nozzles constituting the second nozzle group are arranged alternately to complement each other;

wherein the first nozzle group includes:

a first nozzle; and a second nozzle which deviates from the first nozzle with respect to a second direction perpendicular to the first direction;

wherein the second nozzle group includes:

a third nozzle which is arranged adjacent to the first nozzle with respect to the first direction; and a fourth nozzle which is arranged adjacent to the second nozzle with respect to the first direction;

wherein, with respect to the second direction, the fourth nozzle deviates from the third nozzle in a direction opposite to a direction in which the second nozzle deviates from the first nozzle; and wherein the nozzles constituting the first nozzle group are aligned in a third direction inclined to one side of the second direction with respect to the first direction, and the nozzles constituting the second nozzle group are aligned in a fourth direction inclined to the other side of the second direction with respect to the first direction.

* * * * *